US010562299B2

(12) United States Patent
Suzuki

(10) Patent No.: US 10,562,299 B2
(45) Date of Patent: Feb. 18, 2020

(54) PRINTING APPARATUS

(71) Applicant: SEIKO EPSON CORPORATION, Tokyo (JP)

(72) Inventor: Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/232,105

(22) Filed: Dec. 26, 2018

(65) Prior Publication Data

US 2019/0202203 A1 Jul. 4, 2019

(30) Foreign Application Priority Data

Dec. 28, 2017 (JP) ..... 2017-253599
Mar. 23, 2018 (JP) ..... 2018-056423

(51) Int. Cl.

| | |
|---|---|
| ***B41J 2/045*** | (2006.01) |
| ***B41J 2/14*** | (2006.01) |
| ***B41J 2/145*** | (2006.01) |
| ***B41J 2/025*** | (2006.01) |

(52) U.S. Cl.

CPC ..... *B41J 2/04588* (2013.01); *B41J 2/04541* (2013.01); *B41J 2/04581* (2013.01); *B41J 2/145* (2013.01); *B41J 2/14201* (2013.01); *B41J 2/025* (2013.01); *B41J 2/04596* (2013.01)

(58) Field of Classification Search

CPC ..... B41J 2/04588; B41J 2/04541; B41J 2/04581; B41J 2/04596; B41J 2/04598; B41J 2/14201; B41J 2/145; B41J 2/025

See application file for complete search history.

(56) References Cited

U.S. PATENT DOCUMENTS 9,302,476 B2 * 4/2016 Tsubota ..... B41J 2/04588

FOREIGN PATENT DOCUMENTS

| | | |
|---|---|---|
| JP | 2011-189655 A | 9/2011 |
| JP | 2012-179873 A | 9/2012 |

* cited by examiner

*Primary Examiner* — Thinh H Nguyen

(74) *Attorney, Agent, or Firm* — Global IP Counselors, LLP

(57) ABSTRACT

A drive signal generating unit generates a drive signal during a printing process including a first drive waveform for driving a discharger to discharge a liquid and a first micro-vibration waveform, and generates a drive signal during a discharging state determination process including a second drive waveform for driving the discharger to inspect the discharger, and a second micro-vibration waveform. The first drive waveform becomes a first potential during a first period, becomes a fourth potential during a second period, and becomes the first potential during a third period. The second drive waveform becomes a second potential during a fourth period, becomes a third potential during a fifth period, and becomes the second potential during a sixth period. The first micro-vibration waveform and the second micro-vibration waveform are different from each other.

8 Claims, 29 Drawing Sheets

FIG. 10

| sd[m] SPECIFICATION CONTENT | SLa[m] | | | SLb[m] | | | SLs[m] | | |
|---|---|---|---|---|---|---|---|---|---|
| | TSS1 | TSS2 | TSS3 | TSS1 | TSS2 | TSS3 | TSS1 | TSS2 | TSS3 |
| DETERMINATION TARGET (D_H) | H | L | H | L | L | L | L | H | L |
| NON-TARGET (D_R) | L | L | L | H | H | H | L | L | L |

FIG. 12

| Info-S | Info-T (NTc COMPARISON RESULT) | Stt |
|---|---|---|
| 1 | NTc < Tth1 | 2 : DISCHARGING ABNORMALITY (BUBBLES) |
| | Tth1 ≤ NTc ≤ Tth2 | 1 : NORMAL |
| | Tth2 < NTc ≤ Tth3 | 3 : DISCHARGING ABNORMALITY (FOREIGN MATTER) |
| | Tth3 < NTc | 4 : DISCHARGING ABNORMALITY (THICKENING) |
| 0 | N/A | 5 : DISCHARGING ABNORMALITY |

<RELATIONSHIP BETWEEN DISPLACEMENT AND APPLIED VOLTAGE OF PIEZOELECTRIC CHARACTERISTICS ACCORDING TO RANK>

PRINTING APPARATUS

The entire disclosure of Japanese Patent Application No. 2017-253599, filed Dec. 28, 2017 and No. 2018-056423, filed Mar. 23, 2018 are expressly incorporated by reference herein.

BACKGROUND

1. Technical Field

The present invention relates to a printing apparatus.

2. Related Art

In a printing apparatus such as an ink jet printer, a piezoelectric element of a discharger is displaced by driving of the discharger which is provided in a recording head. According to the displacement, a liquid such as an ink which fills a cavity (a pressure chamber) of the discharger is discharged and an image is formed on a recording medium. In the printing apparatus, a discharging abnormality in which the liquid may not be normally discharged from the discharger may occur due to the viscosity of the liquid inside the cavity increasing (thickening), foreign matter adhering to the discharger, or the like. When the discharging abnormality occurs, a dot is not accurately formed by the liquid which is discharged from the discharger and the quality of the image which is formed on the recording medium is reduced. Therefore, in order to prevent a reduction in the image quality originating in the discharging abnormality, there is proposed a technique of detecting a residual vibration which is generated in the discharger when the discharger is driven and determining a discharging state of the liquid in the discharger based on the residual vibration (for example, refer to JP-A-2012-179873).

However, in the technique described above, there is a problem in that it is necessary to rank the dischargers (the piezoelectric elements) which serve as the individual inspection targets and determine the inspection result while taking the rank into consideration.

SUMMARY

According to an aspect of the invention, there is provided a printing apparatus which includes a first discharger which discharges a liquid in accordance with driving of a first piezoelectric element, a drive signal generating unit which generates a drive signal including a first drive waveform for driving the first discharger and discharging the liquid, during a printing process, a first micro-vibration waveform for driving the first discharger and not discharging the liquid, during the printing process, a second drive waveform for driving the first discharger and inspecting the first discharger, during a discharging state determination process, and a second micro-vibration waveform for driving the first discharger and not discharging the liquid, during the discharging state determination process, and a residual vibration detection unit which detects an electrical signal corresponding to a residual vibration which is generated inside the first discharger in accordance with supplying of the second drive waveform, in which the first drive waveform becomes a first potential during a first period, becomes a fourth potential during a second period, and becomes the first potential during a third period, in which the second drive waveform becomes a second potential during a fourth period, becomes a third potential during a fifth period, and becomes the second potential during a sixth period, and in which the first micro-vibration waveform and the second micro-vibration waveform are different from each other.

In the printing apparatus according to this configuration, the potential for generating the residual vibration is low in comparison to the potential which is used for discharging the liquid and printing. Therefore, according to the printing apparatus according to this configuration, when the residual vibration is generated, since the influence of various discharger variation factors such as variation in wiring resistance and characteristics of the piezoelectric elements may be suppressed, it is possible to determine the discharging state of the liquid in the discharger without considering the individual differences of the piezoelectric elements, that is, without subjecting the piezoelectric elements to ranking. Since the first micro-vibration waveform and the second micro-vibration waveform are different from each other, it is possible to execute the thickening prevention of the liquid which uses the micro-vibration to be suitable during the printing process and during the discharging state determination process, respectively.

The discharging of the liquid occurs with a direct or an indirect change from the first potential to the fourth potential in the first drive waveform. Therefore, although a plurality of potentials may be used in the discharging of the liquid, the fourth potential referred to here refers to the maximum potential among a plurality of potentials.

In the printing apparatus, the second potential may be lower than the first potential.

According to the printing apparatus according to this configuration, by setting the second potential to be lower than the first potential, it is possible to reduce the pressure which is applied to the pressure chambers of the dischargers which are not the inspection target and to reduce the influence from the dischargers in the periphery of the inspection target, and it is possible to suppress variations caused by the position or the like of the dischargers and to detect the residual vibration without considering the individual differences in the dischargers.

In the printing apparatus, the first micro-vibration waveform may include a waveform which changes from the first potential to a lower potential than the first potential, and the second micro-vibration waveform may include a waveform which changes from the second potential to a higher potential than the second potential. According to the printing apparatus according to this configuration, it is possible to prevent the opposite-polarity electric field from being applied to the piezoelectric elements.

In the printing apparatus, the residual vibration detection unit may detect an electrical signal corresponding to a residual vibration which is generated by the first discharger in the sixth period.

According to the printing apparatus according to this configuration, by performing the detection in the sixth period in which the potential becomes the second potential after changing from the third potential, it is possible to smoothly transition to the first period from before the inspection which is the same second potential and to continuously perform the inspection without generating unnecessary potential changes.

The printing apparatus may further include a second discharger which discharges a liquid in accordance with driving of a second piezoelectric element, in which the first discharger may be included in a discharger row which is formed of a plurality of dischargers, and in which the first discharger and the second piezoelectric element may be driven under the same driving conditions and may be inspected under the same inspection conditions.

According to the printing apparatus according to this configuration, it is possible to perform the inspection without considering which position in the discharger row the inspection target discharger is at or the like. In this configuration, it is preferable that the first discharger be a discharger which is positioned at an end of the discharger row, and that the second discharger be a discharger which is not positioned at an end of the discharger row.

The printing apparatus may further include a plurality of the discharger rows, in which the plurality of discharger rows may be driven under the same driving conditions and may be inspected under the same inspection conditions.

According to the printing apparatus according to this configuration, it is possible to perform the inspection without considering which position in the discharger row the inspection target discharger is at or the like.

The printing apparatus may further include a plurality of the discharger rows, in which the plurality of discharger rows may be inspected in the second drive waveform.

According to the printing apparatus according to this configuration, it is possible to perform the inspection without considering the variation in each of the discharger rows or the like.

In the printing apparatus, an other end of each of the piezoelectric elements may be maintained at a predetermined potential.

According to the printing apparatus according to this configuration, since each other end of the piezoelectric elements is maintained at the predetermined potential in either of a case in which the liquid is discharged and the printing is performed and a case in which the dischargers are inspected, it is possible to suppress the growth of minute cracks in the piezoelectric elements.

BRIEF DESCRIPTION OF THE DRAWINGS

The invention will be described with reference to the accompanying drawings, wherein like numbers reference like elements.

FIG. 10 is an explanatory diagram illustrating an example of a relationship between an individual specification signal and a connection state specification signal.

FIG. 12 is an explanatory diagram for explaining an example of determination information.

DESCRIPTION OF EXEMPLARY EMBODIMENTS

Hereinafter, a description will be given of the embodiments of the invention with reference to the drawings. In the following drawings, the dimensions and scales of each part are different from those in actuality, as appropriate. Since the embodiment described hereinafter is a favorable embodiment of the invention, various technically favorable limits are applied. However, the scope of the invention is not limited thereto as long as there is no wording particularly limiting the invention in the description hereinafter.

Embodiment

A description will be given of a printing apparatus which serves as the embodiment using an ink jet printer which discharges an ink (an example of "a liquid") to form an image on a recording medium P such as a sheet of paper as an example.

Outline of Ink Jet Printer

Figure 1:
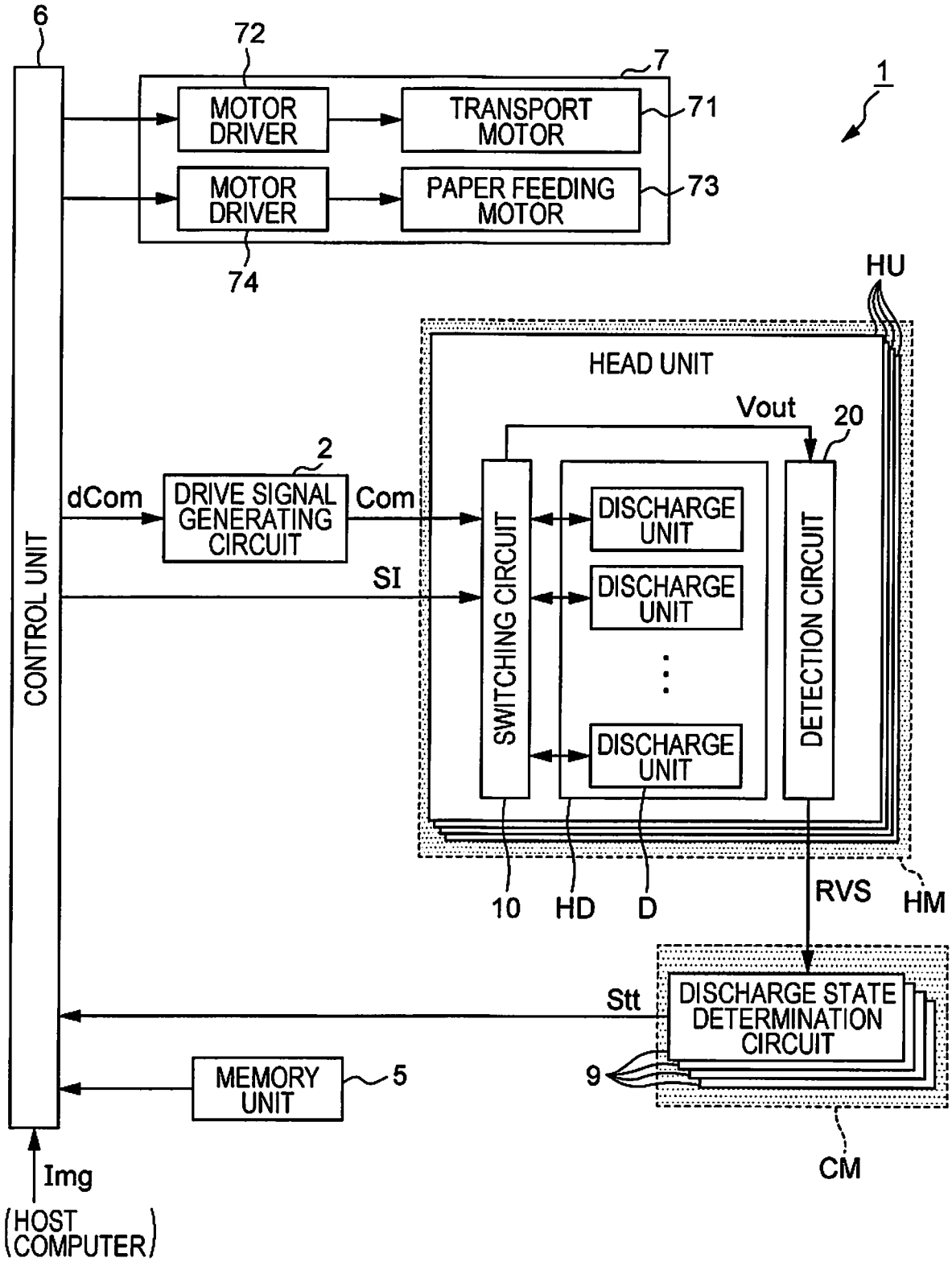
FIG. 1 is a block diagram illustrating an example of the configuration of an ink jet printer according to an embodiment.
Figure 2:
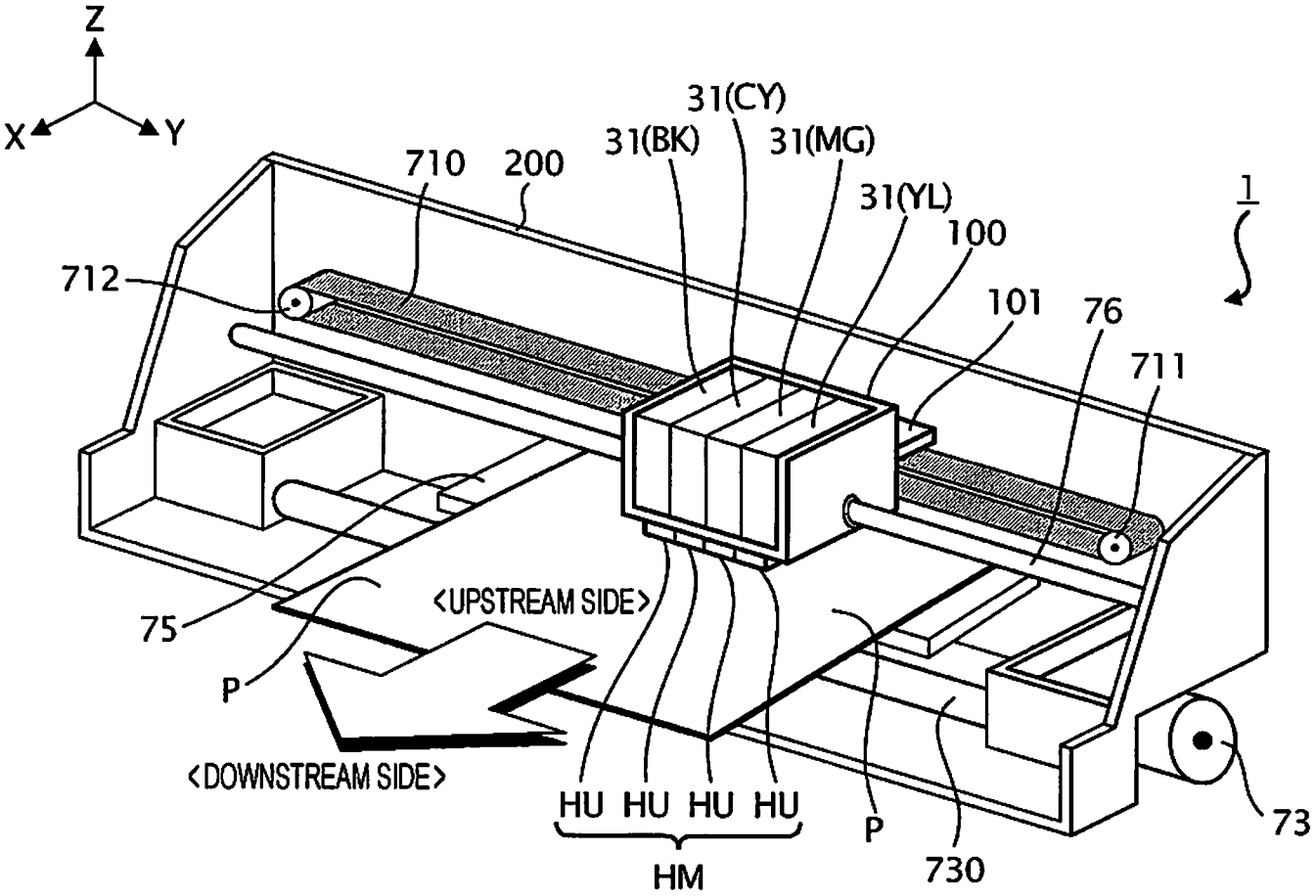
FIG. 2 is a perspective view illustrating an example of the schematic internal structure of the printing apparatus.

FIG. 1 is a block diagram illustrating an example of the configuration of an ink jet printer 1 according to the embodiment, and FIG. 2 is a perspective view illustrating an example of the schematic internal structure of the ink jet printer 1.

Print data Img which indicates an image to be formed by the ink jet printer 1 is supplied to the ink jet printer 1 from a host computer such as a personal computer, a digital camera, or the like. The ink jet printer 1 executes the printing process for forming an image which is indicated by the print data Img on the recording medium P.

As illustrated in FIG. 1, the ink jet printer 1 is provided with a head module HM, a control unit 6, a drive signal generating circuit 2, a transport mechanism 7, a determination module CM, and a memory unit 5. The head module HM includes head units HU which are provided with dischargers D, the control unit 6 controls the parts of the ink jet printer 1, the drive signal generating circuit 2 generates a drive signal Com for driving the dischargers D, the transport mechanism 7 is for changing the relative position of the recording medium P with respect to the head module HM, the determination module CM includes discharging state determination circuits 9 which determine the discharging state of the ink in the dischargers D and outputs determination information Stt indicating the results of the discharging state determination, and the memory unit 5 stores a control program of the ink jet printer 1 and other information.

In the present embodiment, as illustrated in FIG. 1, the head module HM is provided with four of the head units HU, and the determination module CM is provided with four of the discharging state determination circuits 9 which correspond to the four head units HU on a one-to-one basis.

In the present embodiment, each of the head units HU is provided with a recording head HD which includes M dischargers D, a switching circuit 10, and a detection circuit 20 (an example of "a residual vibration detection unit"). In the present embodiment, M is a natural number which satisfies $1 \leq M$.

Hereinafter, in order to distinguish each of the M dischargers D which are provided in each of the recording heads HD, the dischargers D will be referred to in the order of level 1, level 2, . . . , level M. The discharger D of level m will be referred to as the discharger D[m]. The variable m is a natural number which satisfies $1 \leq m \leq M$.

In a case in which the constituent elements, signals, and the like of the ink jet printer 1 correspond to the level m of the discharger D[m], the reference numerals for representing the constituent elements, signals, and the like will be expressed with the suffix [m] indicating that they correspond to the level m.

The switching circuit 10 switches between whether or not to supply the drive signal Com which is output from the drive signal generating circuit 2 to each of the dischargers D. The switching circuit 10 switches between whether or not to electrically connect each of the dischargers D and the detection circuit 20 to each other.

The detection circuit 20 generates a residual vibration signal RVS[m] indicating a vibration (hereinafter referred to as "a residual vibration") which is residual in the discharger D[m] after the discharger D[m] is driven based on the detection signal Vout[m] which is detected from the discharger D[m] which is driven by the drive signal Com.

The discharging state determination circuit 9 generates determination information Stt[m] indicating the result of the discharging state determination of the discharger D[m] based on the residual vibration signal RVS[m]. Hereinafter, the discharger D which serves as the discharging state determination target of the discharging state determination circuit 9 is referred to as a determination target discharger D-H.

A series of processes to be executed in the ink jet printer 1 including a discharging state determination which is executed by the discharging state determination circuit 9 and a residual vibration signal generation process which is a process which generates the residual vibration signal RVS indicating the residual vibration after the discharging state determination circuit 9 drives the determination target discharger D-H to generate the residual vibration in the determination target discharger D-H in order to execute the discharging state determination will be referred to as the discharging state determination process.

Hereinafter, in a case in which the discharging state determination process is executed, the dischargers D other than the determination target discharger D-H will be referred to as the non-target dischargers D-R.

In the present embodiment, for example, a description will be given with the premise that the ink jet printer 1 is a serial printer. Specifically, the ink jet printer 1 executes the printing process by discharging the ink from the discharger D while transporting the recording medium P in a sub-scanning direction and moving the head module HM in a main scanning direction.

In the present embodiment, as illustrated in FIG. 2, a +Y direction and a −Y direction (hereinafter the +Y direction and the −Y direction will be collectively referred to as "the Y-axis direction") are the main scanning direction and a +X direction (hereinafter the +X direction and the −X direction will be collectively referred to as "the X-axis direction") will be referred to as the sub-scanning direction.

As illustrated in FIG. 2, the ink jet printer 1 is provided with a housing 200 and a carriage 100 on which the head module HM is mounted and which is capable of reciprocal movement in the Y-axis direction inside the housing 200.

In a case in which the printing process is executed, the transport mechanism 7 causes the carriage 100 to move reciprocally in the Y-axis direction and transports the recording medium P in the +X direction, and so changes the position of the recording medium P relative to the head module HM and makes it possible for the ink to land on the entirety of the recording medium P.

As illustrated in FIG. 1, the transport mechanism 7 is provided with a transport motor 71, a motor driver 72, a paper feeding motor 73, and a motor driver 74. The transport motor 71 serves as a drive source for causing the carriage 100 to move reciprocally in the Y-axis direction, the motor driver 72 is for driving the transport motor 71, the paper feeding motor 73 serves as a drive source for transporting the recording medium P, and the motor driver 74 is for driving the paper feeding motor 73.

As illustrated in FIG. 2, the transport mechanism 7 includes a carriage guide shaft 76 which extends in the Y-axis direction and a timing belt 710 which bridges between a pulley 711 which is rotationally driven by the transport motor 71 and a pulley 712 which rotates freely, where the timing belt 710 extends in the Y-axis direction. The carriage 100 is supported by the carriage guide shaft 76 to move freely and reciprocally in the Y-axis direction and is fixed to a predetermined location on the timing belt 710 via a fixture 101. Therefore, the transport mechanism 7 is capable of moving the head module HM which is mounted on the carriage 100 in the Y-axis direction along the carriage guide shaft 76 by rotationally driving the pulley 711 using the transport motor 71.

As illustrated in FIG. 2, the transport mechanism 7 is provided with a platen 75, a paper feeding roller (not illustrated, and a paper discharging roller 730. The platen 75 is provided on the bottom side, that is, a −Z direction (hereinafter the −Z direction and the +Z direction will be collectively referred to as "the Z-axis direction") of the carriage 100, the paper feeding roller rotates according to the driving of the paper feeding motor 73 and is for supplying the recording medium P onto the platen 75 one sheet at a time, and the paper discharging roller 730 rotates according to the driving of the paper feeding motor 73 and transports the recording medium P on the platen 75 to a paper discharge port. Therefore, the transport mechanism 7 is capable of transporting the recording medium P on the platen 75 from the −X direction (the upstream side) toward the +X direction (the downstream side).

In the present embodiment, as illustrated in FIG. 2, four ink cartridges 31 corresponding on a one-to-one basis with four colors of ink, cyan (CY), magenta (MG), yellow (YL), and black (BK) are stored on the carriage 100. FIG. 2 is merely an example and the ink cartridges 31 may be provided on the outside of the carriage 100.

In the present embodiment, four head units HU and four ink cartridges 31 are provided to correspond on a one-to-one basis. Each of the dischargers D receives a supply of ink from the ink cartridge 31 corresponding to the head unit HU in which the discharger D is provided. Accordingly, the inner portion of each of the dischargers D is filled with the ink which is supplied and each of the dischargers D is capable of discharging the ink with which the discharger D is filled from a nozzle N. In other words, the total 4M dischargers D which are included in the head module HM are capable of discharging the four colors of ink overall.

The memory unit 5 is configured to include volatile memory such as random access memory (RAM), and non-volatile memory such as read-only memory (ROM), electrically erasable programmable read-only memory (EEPROM), or programmable read-only memory (PROM), and stores various information such as the print data Img which is supplied from the host computer and a control program of the ink jet printer 1.

The control unit 6 is configured to include a central processing unit (CPU). However, the control unit 6 may be provided with a programmable logic device such as a field-programmable gate array (FPGA) instead of a CPU.

The control unit 6 controls the various parts of the ink jet printer 1 by the CPU executing the control program which is stored on the memory unit 5 to operate according to the control program.

Specifically, the control unit 6 generates a print signal SI for controlling the head module HM, a waveform specification signal dCom for controlling the drive signal generating circuit 2, and a signal for controlling the transport mechanism 7.

Here, the waveform specification signal dCom is a digital signal which defines the waveform of the drive signal Com. The drive signal Com is an analog signal for driving the dischargers D. The drive signal generating circuit 2 (an example of "a drive signal generating unit") includes a DA conversion circuit and generates the drive signal Com which has the waveform which is defined by the waveform specification signal dCom. In the present embodiment, a case in which the drive signal Com is a multi-com including a drive signal Com-A and a drive signal Com-B is presumed.

The print signal SI is a digital signal for specifying the type of the operation of the discharger D. Specifically, the print signal SI specifies the type of the operation of the discharger D by specifying whether or not to supply the drive signal Com to the discharger D. Here, the specification of the type of the operation of the discharger D is, for example, specifying whether or not to drive the discharger D, specifying whether or not the ink is discharged from the discharger D when the discharger D is driven, specifying the amount of the ink to be discharged from the discharger D when the discharger D is driven, and the like.

In a case in which the printing process is executed, the control unit 6 first stores the print data Img which is supplied from the host computer in the memory unit 5. Next, the control unit 6 generates the print signal SI, the waveform specification signal dCom, the various control signals for controlling the transport mechanism 7, and the like based on various data such as the print data Img which is stored in the memory unit 5. The control unit 6 controls the head module HM such that the dischargers D are driven while controlling the transport mechanism 7 so as to change the position of the recording medium P relative to the head module HM based on the various control signals and the various data which is stored in the memory unit 5. Accordingly, the control unit 6 adjusts whether or not to discharge the ink from the dischargers D, the discharge amount of the ink, the discharge timing of the ink, and the like and controls the execution of the printing process which forms the image corresponding to the print data Img on the recording medium P.

A printing task which is executed in order to form a single image which is indicated by the print data Img is repeatedly executed a plurality of times in order to form a number of copies that is specified separately.

As described above, the discharging state determination process which determines whether or not the discharging state of the ink from each of the dischargers D is normally, that is, whether or not a discharging abnormality occurs in each of the dischargers D is executed in the ink jet printer 1 according to the present embodiment.

Here, the discharging abnormality refers to a state in which the ink may not be discharged due to the form which is defined by the drive signal Com even if the discharger D is to be driven to discharge the ink from the discharger D by the drive signal Com. Here, the discharging form of the ink which is defined by the drive signal Com means the discharger D discharging an amount of the ink which is defined by the waveform of the drive signal Com and the discharger D discharging the ink at a discharge speed which is defined by the waveform of the drive signal Com. In other words, in addition to a state in which the ink may not be discharged from the discharger D, examples of states in which the ink may not be discharged due to the discharge form of the ink which is defined by the drive signal Com include a state in which a different amount of the ink is discharged from the discharger D from the discharge amount of the ink which is defined by the drive signal Com, and a state in which the ink may not be caused to land at the desired landing position on the recording medium P because the ink is discharged at a different speed from the discharge speed of the ink which is defined by the drive signal Com.

In the discharging state determination process, the ink jet printer 1 executes a series of processes. First, the ink jet printer 1 uses the control unit 6 to select the determination target discharger D-H from among the M dischargers D which are provided in each of the head unit HU, second the ink jet printer 1 causes the determination target discharger D-H to generate a residual vibration by driving the determination target discharger D-H under the control of the control unit 6, third, the ink jet printer uses the detection circuit 20 to generate the residual vibration signal RVS based on the detection signal Vout which is detected from the determination target discharger D-H, fourth, the ink jet printer 1 uses the discharging state determination circuit 9 to perform the discharging state determination using the determination target discharger D-H as a target based on the residual vibration signal RVS and to generate the determination information Stt indicating the result of the determination, and fifth, the ink jet printer 1 uses the control unit 6 to cause the memory unit 5 to store the determination information Stt.

Outline of Recording Head and Discharger

Next, a description will be given of the recording head HD and the dischargers D which are provided in the recording head HD with reference to FIGS. 3 to 5.

Figure 3:
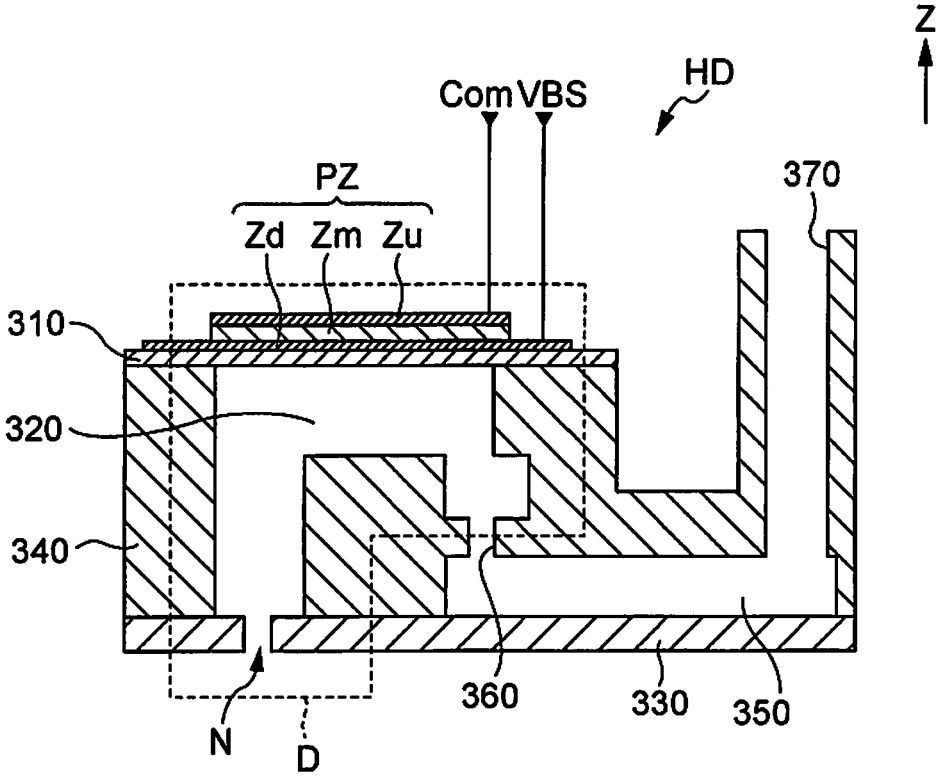
FIG. 3 is an explanatory diagram for explaining an example of the structure of a discharger.

FIG. 3 is a schematic partial sectional diagram of the recording head HD in which the recording head HD is cut to include the discharger D.

As illustrated in FIG. 3, the discharger D is provided with a piezoelectric element PZ, a cavity 320, the nozzle N, and a vibration plate 310. The inner portion of the cavity 320 is filled with the ink and the nozzle N communicates with the cavity 320.

The cavity 320 is a space which is partitioned by a cavity plate 340, a nozzle plate 330 in which the nozzles N are formed, and the vibration plate 310. The cavity 320 communicates with a reservoir 350 via an ink supply port 360. The reservoir 350 communicates with the ink cartridge 31 which corresponds to the discharger D via an ink acquisition inlet 370.

Hereinafter, of the cavity plate 340, a portion which partitions the cavity 320 of one discharger D and the cavity 320 of another discharger D and a portion which partitions the cavity 320 of the discharger D which is positioned at the end portion of the recording head HD and the outer portion of the recording head HD will be referred to as partitioning walls 340A (refer to FIGS. 22, 23, 25, and 26 which are described later).

The piezoelectric element PZ includes a top portion electrode Zu, bottom portion electrode Zd, and a piezoelectric body Zm which is provided between the top portion electrode Zu and the bottom portion electrode Zd. The bottom portion electrode Zd is electrically connected to a power supply line LHd (refer to FIG. 6) in which the bottom portion electrode Zd is set to the potential VBS and the drive signal Com is supplied to the top portion electrode Zu. In the piezoelectric element PZ, when a voltage is applied between the top portion electrode Zu and the bottom portion electrode Zd, the center portion of the piezoelectric element PZ is displaced in the +Z direction or the −Z direction as compared to the peripheral edge portions, and as a result, the piezoelectric element PZ vibrates.

In the present embodiment, a unimorph (monomorph) piezoelectric element PZ such as the one illustrated in FIG. 3 is adopted. However, the piezoelectric element PZ is not limited to being a unimorph piezoelectric element and a biomorph piezoelectric element, a laminated piezoelectric element, or the like may also be adopted.

The vibration plate 310 is installed on the top surface opening portion of the cavity plate 340. The bottom portion electrode Zd is bonded to the vibration plate 310. Therefore, when the piezoelectric element PZ is driven by the drive signal Com to vibrate, the vibration plate 310 also vibrates. The volume of the cavity 320 changes according to the vibration of the vibration plate 310 and the ink with which the cavity 320 is filled is discharged from the nozzle N. In a case in which the ink inside the cavity 320 is depleted through the discharging of the ink, the ink is supplied from the reservoir 350.

Figure 4:
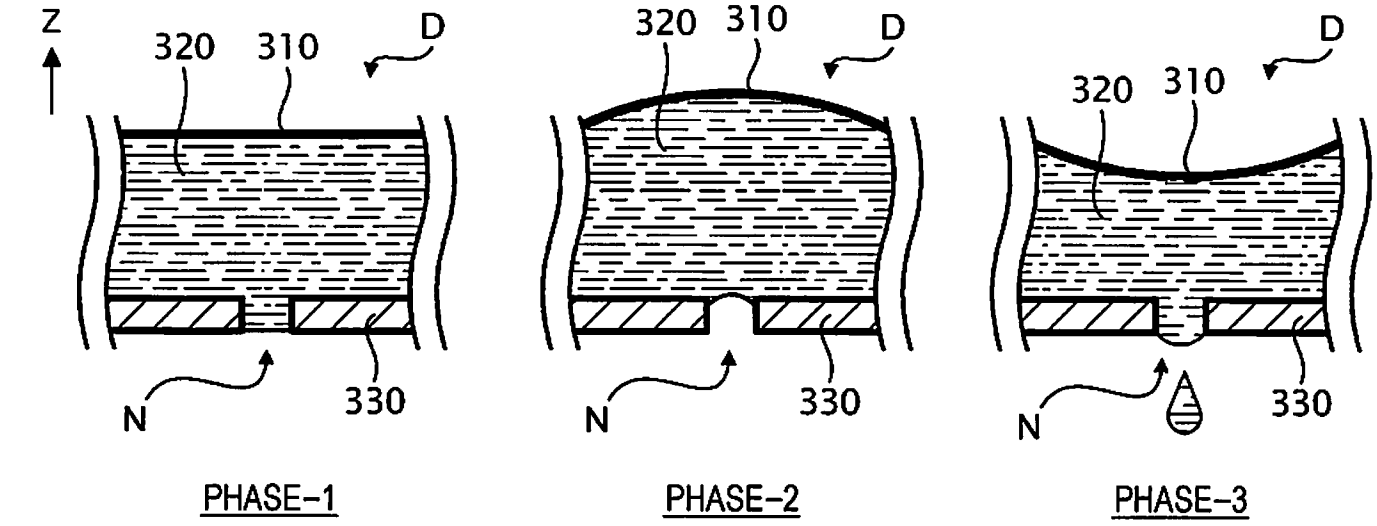
FIG. 4 is an explanatory diagram for explaining an example of a discharging operation of a discharger.

FIG. 4 is an explanatory diagram for explaining an example of the discharging operation of the discharger D.

As illustrated in FIG. 4, in the state of Phase-1, the control unit 6 causes the piezoelectric element PZ to generate a distortion such that the piezoelectric element PZ is displaced in the +Z direction and causes the vibration plate 310 of the discharger D to flex in the +Z direction by changing the potential of the drive signal Com which is supplied to the piezoelectric element PZ which is provided in the discharger D. Accordingly, as in the state of Phase-2 illustrated in FIG. 4, in comparison to the state of Phase-1, the volume of the cavity 320 of the discharger D is expanded. Next, by changing the potential of exhibited by the drive signal Com, the control unit 6 causes the piezoelectric element PZ to generate a distortion such that the piezoelectric element PZ is displaced in the −Z direction and causes the vibration plate 310 of the discharger D to flex in the −Z direction. Accordingly, as in the state of Phase-3 illustrated in FIG. 4, the volume of the cavity 320 quickly contracts and s portion of the ink which fills the cavity 320 is discharged as an ink droplet from the nozzle N which communicates with the cavity 320.

After the piezoelectric element PZ and the vibration plate 310 are driven by the drive signal Com to be displaced in the Z-axis direction, a residual vibration is generated in the discharger D which includes the vibration plate 310.

The displacement directions and displacement amounts of the piezoelectric element PZ illustrated in FIG. 4, or in FIGS. 20, 22, 23, 25, and 26 which are described later are merely examples for illustrating the relative expansion and contraction of the volume of the cavity 320. Therefore, the piezoelectric element PZ is not necessarily displaced as illustrated.

Figure 5:
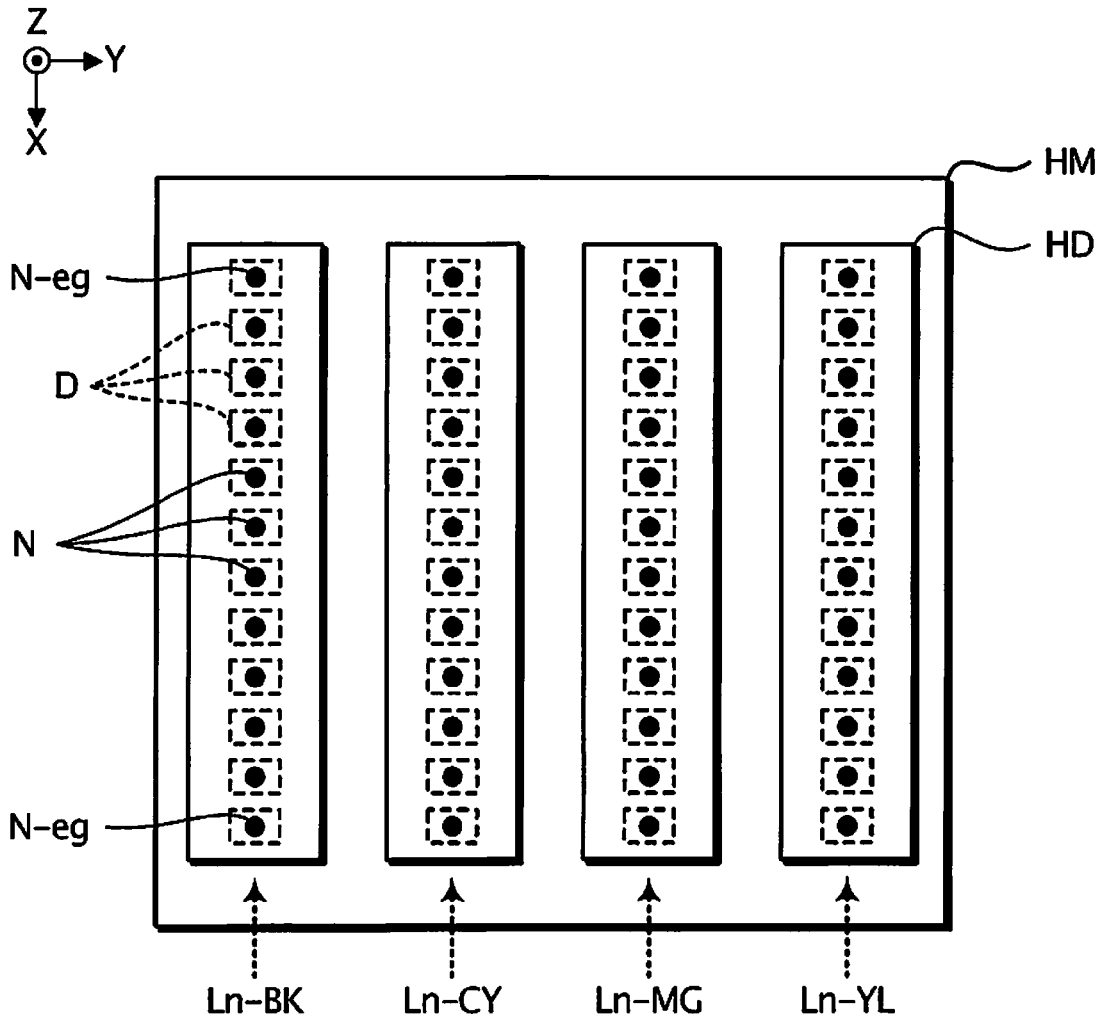
FIG. 5 is a plan view illustrating an example of nozzle disposition in a head module.

FIG. 5 is an explanatory diagram for explaining an example of the disposition of the four recording heads HD which are included in the head module HM and the total 4M nozzles N which are provided on the four recording heads HD in a case in which the ink jet printer 1 is viewed from the +Z direction or the −Z direction in plan view.

As illustrated in FIG. 5, a nozzle row Ln is provided on each of the recording heads HD which is provided in the head module HM. Here, the nozzle row Ln is a plurality of the nozzles N which are provided to extend in a row form in a predetermined direction. In the present embodiment, each of the nozzle rows Ln is configured by displacing M nozzles N to extend in row form in the X-axis direction.

Hereinafter, the four nozzle rows Ln which are provided in the head module HM are referred to as nozzle rows Ln-BK, Ln-CY, Ln-MG, and Ln-YL. Here, the nozzle row Ln-BK is the nozzle row Ln in which the nozzles N of the dischargers D which discharge the black ink are arranged, the nozzle row Ln-CY is the nozzle row Ln in which the nozzles N of the dischargers D which discharge the cyan ink are arranged, the nozzle row Ln-MG is the nozzle row Ln in which the nozzles N of the dischargers D which discharge the magenta ink are arranged, and the nozzle row Ln-YL is the nozzle row Ln in which the nozzles N of the dischargers D which discharge the yellow ink are arranged. Hereinafter, as illustrated in FIG. 5, there is a case in which the nozzle N which is positioned at the end portion of the nozzle row Ln among the plurality of nozzles N which belong to each of the nozzle rows Ln will be referred to as an end portion nozzle N-eg.

FIG. 5 is an example and the M nozzles N which belong to each of the nozzle rows Ln may be disposed to have a predetermined width in a direction intersecting the direction in which the nozzle row Ln extends. In other words, in each of the nozzle rows Ln, the M nozzles N which belong to each of the nozzle rows Ln may be disposed alternately, for example, such that the positions of the nozzles N which are an even number from the +X side and the nozzles N which are an odd number from the +X side are different in the Y-axis direction. Each of the nozzle rows Ln may extend in a different direction from the X-axis direction. In the present embodiment, a case is exemplified in which the number of rows of the nozzle row Ln which is provided in each of the recording heads HD is "1". However, two or more nozzle rows Ln may be provided on each of the recording heads HD.

Configuration of Head Unit

Next, a description will be given of the configuration of each of the head units HU with reference to FIG. 6.

Figure 6:
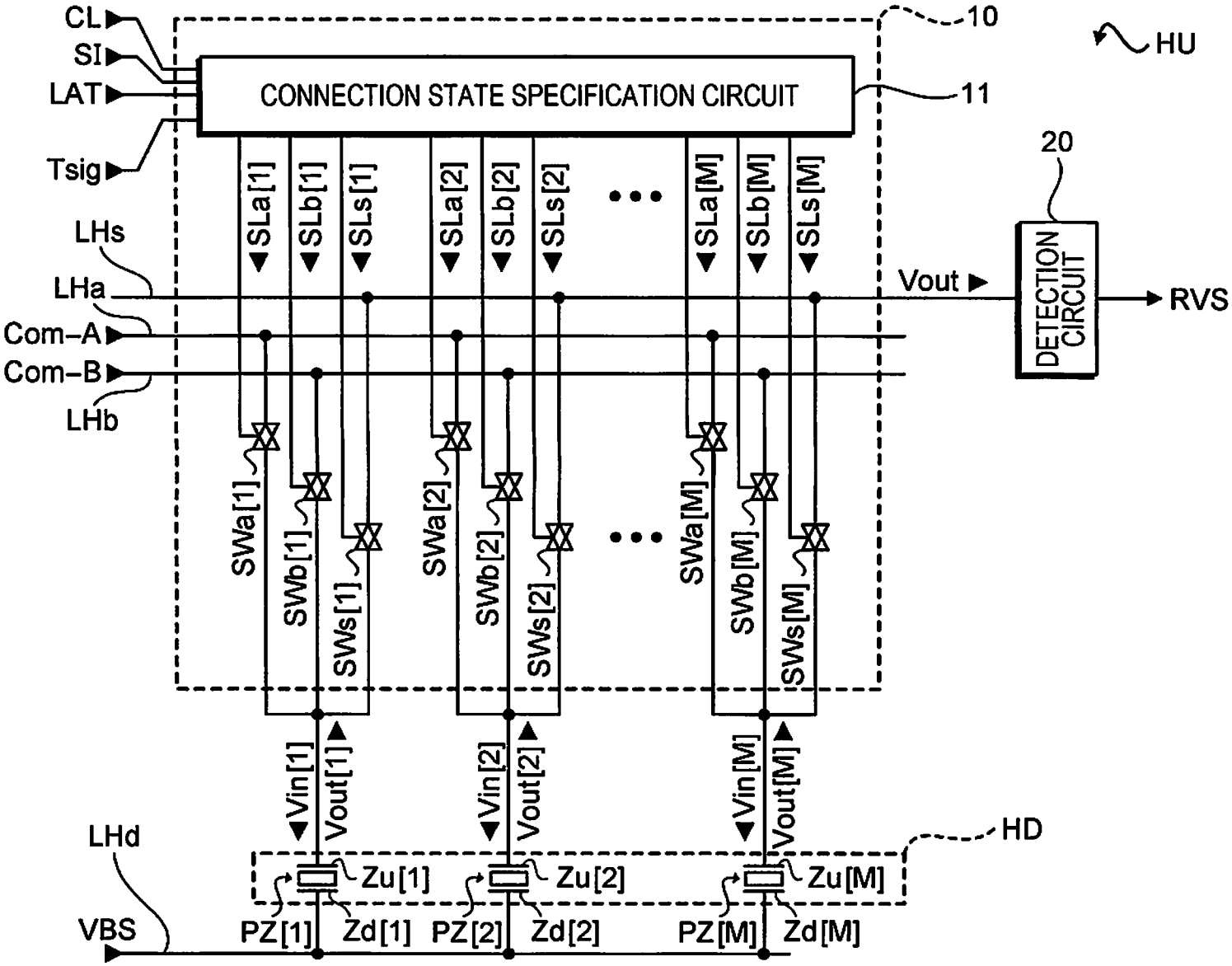
FIG. 6 is a block diagram illustrating an example of the configuration of a head unit.

FIG. 6 is a block diagram illustrating an example of the configuration of the head unit HU. As described above, the head unit HU is provided with the recording head HD, the switching circuit 10, and the detection circuit 20. The head unit HU is provided with internal wirings LHa, LHb, and LHs. The internal wiring LHa is supplied with the drive signal Com-A from the drive signal generating circuit 2, the internal wiring LHb is supplied with the drive signal Com-B from the drive signal generating circuit 2, and the internal wiring LHs is for supplying the detection signal Vout which is detected from the discharger D to the detection circuit 20.

As illustrated in FIG. 6, the switching circuit 10 is provided with M switches SWa (SWa[1] to SWa[M]), M switches SWb (SWb[1] to SWb[M]), M switches SWs (SWs[1] to SWs[M]), and a connection state specification circuit 11 which specifies the connection state of each of the switches. It is possible to adopt a transmission gate, for example, for each of the switches.

The connection state specification circuit 11 generates the connection state specification signals SLa[1] to SLa[M], the connection state specification signals SLb[1] to SLb[M], and the connection state specification signals SLs[1] to SLs[M] based on at least a portion of the signals of the print signal SI, the latch signal LAT, and a period specification signal Tsig which are supplied from the control unit 6. The connection state specification signals SLa[1] to SLa[M] specify whether each of the switches SWa[1] to SWa[M] is on or off, the connection state specification signals SLb[1] to SLb[M] specify whether each of the switches SWb[1] to SWb[M] is on or off, and the connection state specification signals SLs[1] to SLs[M] specify whether each of the switches SWs[1] to SWs[M] is on or off.

The switch SWa[m] turns on (conducting) or off (non-conducting) between the internal wiring LHa and the top portion electrode Zu[m] of the piezoelectric element PZ[m] which is provided in the discharger D[m] according to the connection state specification signal SLa[m]. In the present embodiment, the switch SWa[m] turns on in a case in which the connection state specification signal SLa[m] is a high level and turns off in a case in which the connection state specification signal SLa[m] is a low level.

The switch SWb[m] turns on or off between the internal wiring LHb and the top portion electrode Zu[m] of the piezoelectric element PZ[m] which is provided in the discharger D[m] according to the connection state specification signal SLb[m]. In the present embodiment, the switch SWb[m] turns on in a case in which the connection state specification signal SLb[m] is a high level and turns off in a case in which the connection state specification signal SLb[m] is a low level.

The switch SWs[m] turns on or off between the internal wiring LHs and the top portion electrode Zu[m] of the piezoelectric element PZ[m] which is provided in the discharger D[m] according to the connection state specification signal SLs[m]. In the present embodiment, the switch SWs[m] turns on in a case in which the connection state specification signal SLs[m] is a high level and turns off in a case in which the connection state specification signal SLs[m] is a low level.

The detection signal Vout[m] which is output from the piezoelectric element PZ[m] of the discharger D[m] which is driven as the determination target discharger D-H is supplied to the detection circuit 20 via the internal wiring LHs. The detection circuit 20 generates the residual vibration signal RVS[m] based on the detection signal Vout[m].

Operation of Head Unit

Hereinafter, a description will be given of the operation of each of the head units HU with reference to FIGS. 7 to 11.

In the present embodiment, the operation period of the ink jet printer 1 includes one or a plurality of unit periods Tu. The ink jet printer 1 according to the present embodiment is capable of selectively executing one of the driving of each of the dischargers D in the printing process and the driving of the determination target discharger D-H and detecting of the residual vibration thereof in the discharging state determination process in each of the unit periods Tu. Hereinafter, the unit period Tu in which each of the dischargers D is driven as the printing process will be referred to as a unit printing period Tu-P, and the unit period Tu in which the determination target discharger D-H is driven and the residual vibration is detected as the discharging state determination process will be referred to as a unit determination period Tu-H.

Generally, the ink jet printer 1 repeatedly executes the printing process over a continuous or intermittent plurality of unit printing periods Tu-P and causes the ink to be discharged one or a plurality of times from each of the dischargers D, and so, executes the printing task which forms an image which is indicated by the printer Img.

In a case in which the printing task is not executed, when a predetermined condition is satisfied, for example, when there is manipulation by the user, when the printing task is repeated a predetermined number of times, when a predetermined time elapses from the end of the previous printing task, or the like, the ink jet printer 1 according to the present embodiment executes the discharging state determination process which determines the discharging state of each of the dischargers D.

In detail, the ink jet printer 1 executes the discharging state determination process in which the M dischargers D[1] to D[M] are used as the determination target dischargers D-H by executing the discharging state determination process M times in M unit determination periods Tu-H which are provided consecutively or intermittently. In each of the unit determination periods Tu-H, one determination target discharger D-H is selected from among the M dischargers D[1] to D[M] which are provided in each of the head units HU.

Figure 7:
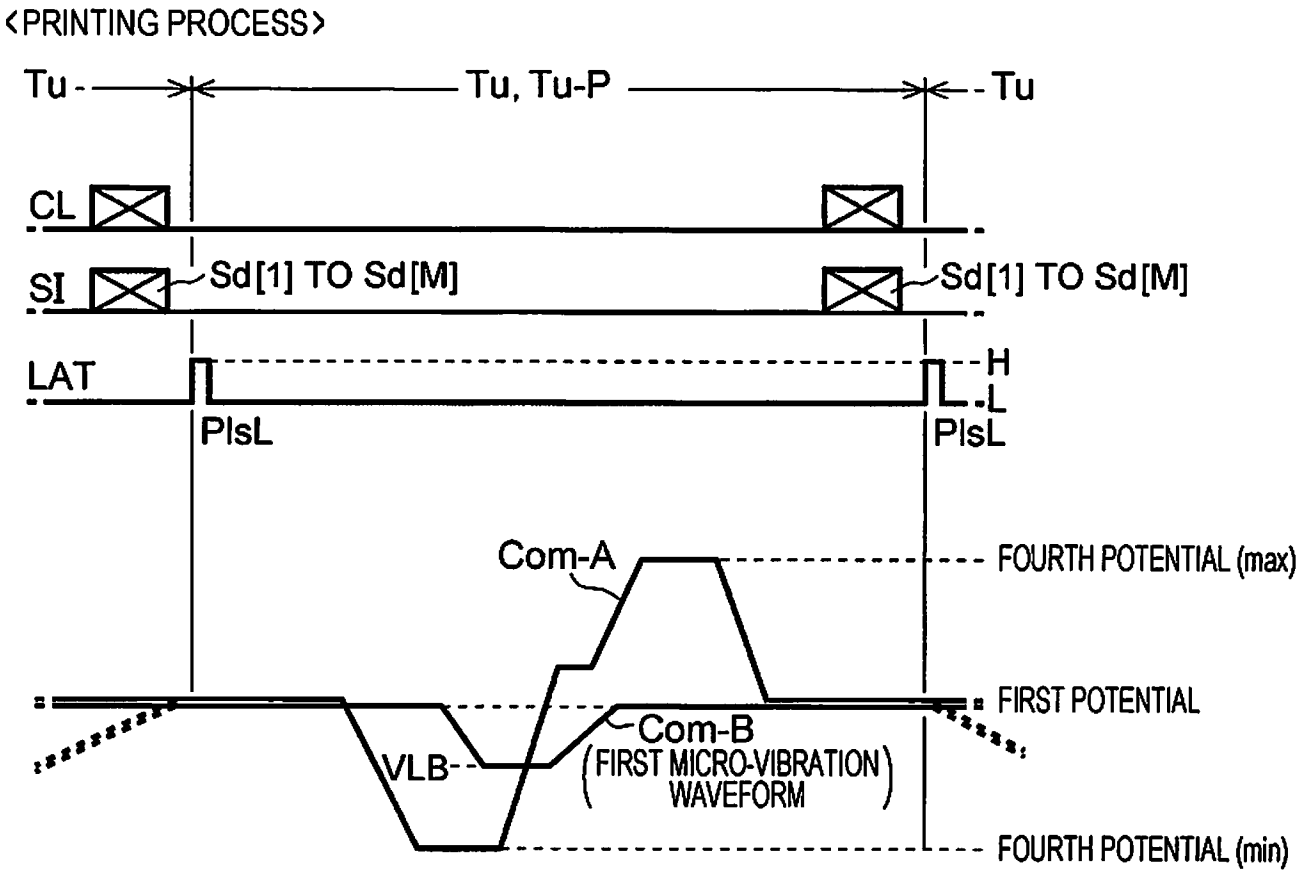
FIG. 7 is a diagram illustrating drive waveforms and the like during a printing process.
Figure 8:
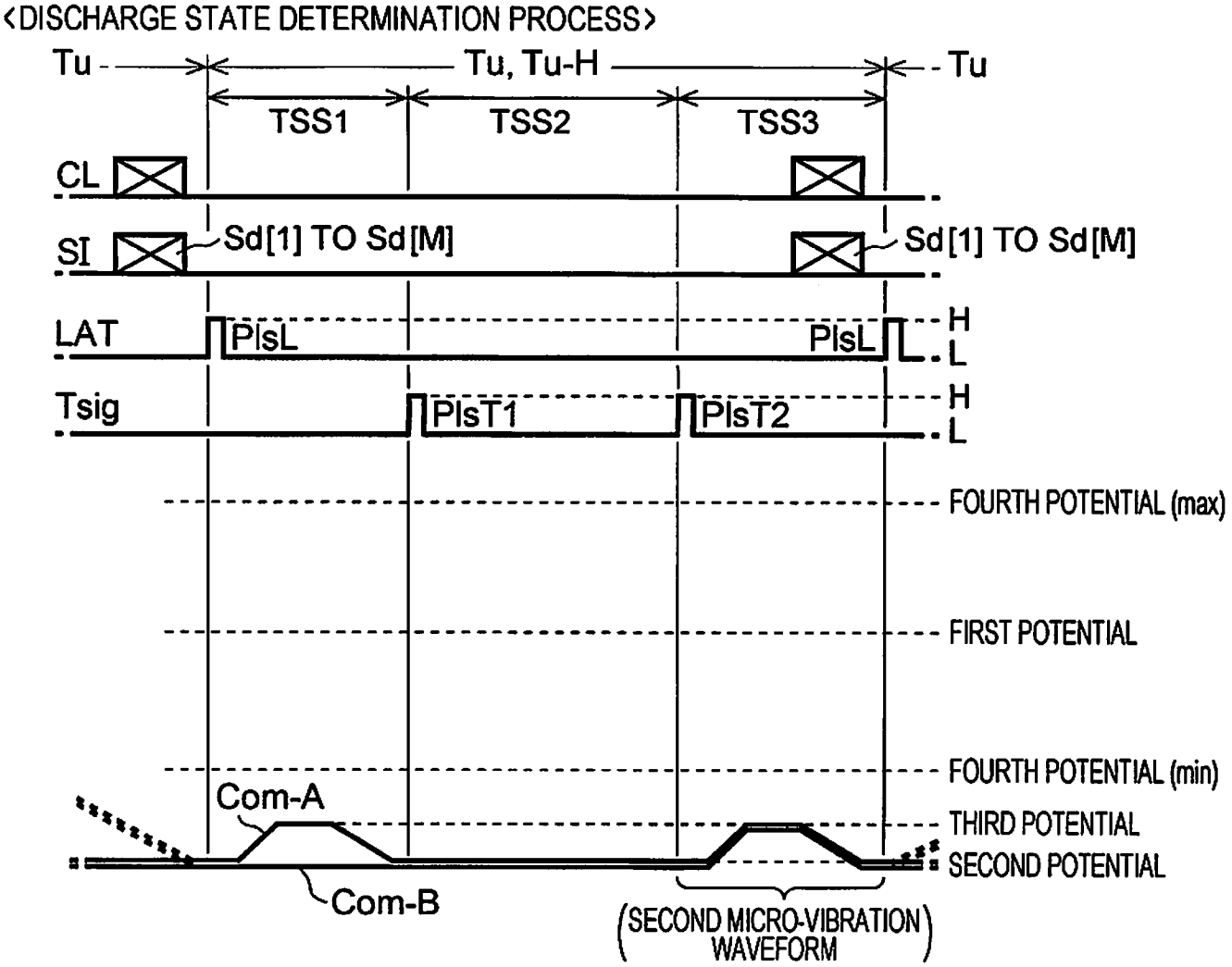
FIG. 8 is a diagram illustrating drive waveforms and the like during a discharging state determination process.

FIGS. 7 and 8 are diagrams for illustrating the operations of the ink jet printer 1 in the unit period Tu. Of these, FIG. 7 illustrates the operation of the ink jet printer 1 in the unit printing period Tu-P and FIG. 8 illustrates the operation of the ink jet printer 1 in the unit determination period Tu-H.

As illustrated in FIGS. 7 and 8, the control unit 6 outputs the latch signal LAT which includes a pulse PlsL. Accordingly, the control unit 6 defines the unit period Tu as the period from the leading edge of the pulse PlsL until the leading edge of the next pulse PlsL.

In the unit printing period Tu-P, each of the dischargers D discharges the ink one or more times and it is possible to cause the dot side to be different according to the sum of the ink amounts which are discharged in the unit printing period Tu-P. However, in order to facilitate explanation hereinafter, the description will be given assuming a configuration in which each discharger discharges the ink one time or does not discharge the ink in the unit printing period Tu-P during the printing process.

As illustrated in FIGS. 7 and 8, individual specification signals Sd[1] to Sd[M] which specify the form of the driving of the dischargers D[1] to D[M] in each of the unit periods Tu are included in the print signal SI which is output by the control unit 6. In a case in which the control unit 6 executes the printing process or the discharging state determination process in the unit period Tu, the control unit 6 supplies the print signal SI including the individual specification signals Sd[1] to Sd[M] to the connection state specification circuit 11 in synchronization with the clock signal CL before the unit period Tu. In this case, the connection state specification circuit 11 generates the connection state specification signals SLa[m], SLb[m], and SLs[m] based on the individual specification signal Sd[m] in the unit period Tu.

The individual specification signal Sd[m] according to the present embodiment specifies one of discharging the ink (forming a dot) or not discharging the ink (not forming a not) with respect to the discharger D[m] in each of the unit printing periods Tu-P of the printing process.

Meanwhile, the individual specification signal Sd[m] specifies one of driving the discharger D[m] as the determination target discharger D-H or driving the discharger D[m] as the non-target discharger D-R in each of the unit determination periods Tu-H of the discharging state determination process.

As illustrated in FIG. 8, the control unit 6 outputs the period specification signal Tsig which includes pulses PlsT1 and PlsT2 in the unit determination period Tu-H. The control unit 6 divides the unit determination period Tu-H into a control period TSS1 from the leading edge of the pulse PlsL until the leading edge of the pulse PlsT1, a control period TSS2 from the leading edge of the pulse PlsT1 until the leading edge of the pulse PlsT2, and a control period TSS3 from the leading edge of the pulse PlsT2 until the leading edge of the next pulse PlsL.

As described above, in the present embodiment, the drive signal generating circuit 2 outputs the two types of drive signal Com-A and Com-B as the drive signal Com.

In the present embodiment, in the unit printing period Tu-P, the drive signal Com-A is supplied to the discharger D[m] which forms a dot and the drive signal Com-B is supplied to the discharger DM which does not form a dot. Meanwhile, in the unit determination period Tu-H, the drive signal Com-A is supplied to the determination target discharger D-H in the control periods TSS1 and TSS3 and neither the drive signal Com-A nor the drive signal Com-B is supplied to the control period TSS2. In the unit printing period Tu-P, the drive signal Com-B is supplied to the non-target discharger D-R.

During the execution of the printing process, the drive signals Com-A and Com-B are waveforms such as those illustrated in FIG. 7, for example.

The drive signal Com-A in the unit printing period Tu-P is a waveform for causing the ink to be discharged from the discharger D. Specifically, the drive signal Com-A in the unit printing period Tu-P lowers from a first potential to a fourth potential (min), briefly maintains the fourth potential (min), subsequently rises to the fourth potential (max) with an intervening fixed potential section midway, and lowers to the first potential after briefly maintaining the fourth potential (max). The drive signal Com-A may also rise from the fourth potential (min) to the fourth potential (max) without an intervening fixed potential section.

The drive signal Com-B in the unit printing period Tu-P is a waveform which sets the ink from the discharger D to non-discharging (does not cause the ink to be discharged), and is a micro-vibration waveform (an example of a first micro-vibration waveform) for preventing the thickening of the ink which fills the cavity 320 of the discharger D. Specifically, the drive signal Com-B in the unit printing period Tu-P lowers from the first potential to a potential VLB, and rises to the first potential after briefly maintaining the potential VLB.

At the start and at the end of the unit printing period Tu-P, both the drive signal Com-A and the drive signal Com-B are at the first potential.

During the execution of the discharging state determination process, the drive signals Com-A and Com-B are waveforms such as those illustrated in FIG. 8, for example.

The drive signal Com-A in the unit determination period Tu-H is a waveform which excites the residual vibration in the piezoelectric element PZ in the control period TSS1, is fixed at the second potential in the control period TSS2, and is a micro-vibration waveform in the control period TSS3.

Specifically, the drive signal Com-A rises from the second potential to the third potential in the control period TSS1, lowers to the second potential after briefly maintaining the third potential, maintains the second potential in the control period TSS2, rises to the third potential from the second potential in the control period TSS3, and lowers to the second potential after briefly maintaining the third potential.

The drive signal Com-B in the unit determination period Tu-P is fixed at the second potential in the control periods TSS1 and TSS2 and is a similar micro-vibration waveform to the drive signal Com-A in the control period TSS3.

In the control period TSS3, the drive signals Com-A and Com-B are an example of a second micro-vibration waveform. At the start and at the end of the control periods TSS1, TSS2, and TSS3 in the unit printing period Tu-P, both the drive signal Com-A and the drive signal Com-B are at the second potential.

In the present embodiment, the difference between the second potential and the third potential in the unit determination period Tu-H is smaller than the difference between the potential VLB and the first potential in the unit determination period Tu-P. The reason that the difference between the second potential and the third potential is smaller than the difference between the potential VLB and the first potential is because, when causing the discharger D to perform a micro-vibration, although it is desirable that the displacement amount of the piezoelectric element PZ in the unit determination period Tu-H be approximately the same as the displacement amount of the piezoelectric element PZ in the unit printing period Tu-P, the characteristic of the displacement amount in relation to the voltage change in the piezoelectric element PZ (an electromotive conversion characteristic) is not linear in relation to the applied voltage. In detail, this is because in a case in which approximately the same fluctuation amount is necessary, the change amount of the voltage in a state in which the applied voltage is low (the discharging state determination process in which the reference of the change is the second potential) may be smaller than the change amount in a state in which the applied voltage is high (the printing process in which the reference of the change is the first potential).

In a case in which the individual specification signal Sd[m] specifies that a dot is to be formed during the execution of the printing process, the connection state specification circuit 11 sets the connection state specification signal SLa[m] to a high level in the unit printing period Tu-P and sets the connection state specification signals SLb[m] and SLs[m] to a low level. In this case, since the discharger D[m] is driven by the drive signal Com-A to discharge the ink, a dot is formed on the recording medium P.

Meanwhile, in a case in which the individual specification signal Sd[m] specifies that a dot is not to be formed during the execution of the printing process, the connection state specification circuit 11 sets the connection state specification signal SLb[m] to a high level in the unit printing period Tu-P and sets the connection state specification signals SLa[m] and SLs[m] to a low level. In this case, since the discharger D[m] is driven by the drive signal Com-B to not discharge the ink, a dot is not formed on the recording medium P.

In a case in which the process transitions from the printing process to the discharging state determination process, the drive signals Com-A and Com-B gradually lower from the first potential to the second potential as illustrated by the dashed lines in FIGS. 7 and 8. During the transition, either the drive signal Com-A or the drive signal Com-B is supplied to all of the piezoelectric elements PZ.

Conversely, in a case in which the process transitions from the discharging state determination process to the printing process, the drive signals Com-A and Com-B gradually rise from the second potential to the first potential as illustrated by the dashed lines in FIGS. 7 and 8. During the transition, either the drive signal Com-A or the drive signal Com-B is supplied to all of the piezoelectric elements PZ.

During the transition of the processes, the drive signals Com-A and Com-B are caused to gradually change from one to the other of either the first potential or the second potential and the reason that either the drive signal Com-A or the drive signal Com-B is supplied to all of the piezoelectric elements PZ is as follows. In other words, since the piezoelectric element PZ is a capacitor from an electrical perspective, the piezoelectric element PZ has a characteristic of holding the voltage from directly before one of the switches SWa or SWb turns off. Therefore, when changing from one to the other of the first potential or the second potential, when the piezoelectric element PZ is in a state in which both of the switches are off (that is, a state in which neither the drive signal Com-A nor the drive signal Com-B is supplied), when one of the switches turns on next, there is a possibility that the ink will be erroneously discharged by the change in the potential. In order to prevent such erroneous discharging, during the transition of the processes, time is spent changing the drive signals Com-A and Com-B from one to the other of the first potential or the second potential, and one of the drive signals Com-A or Com-B in which the potential is changed in this manner is supplied to all of the piezoelectric elements PZ to change the held voltage of the piezoelectric elements PZ.

FIG. 10 is an explanatory diagram for explaining the relationship between the individual specification signal Sd[m], and the connection state specification signals SLa [m], SLb[m], SLs[m] in the unit determination period Tu-H.

In the present embodiment, during the execution of the discharging state determination process, as illustrated in FIG. 10, there are two cases, a case in which the individual specification signal Sd[m] specifies driving for the determination target discharger D-H, and a case in which the individual specification signal Sd[m] specifies driving for the non-target discharger D-R.

In a case in which the individual specification signal Sd[m] specifies the driving for the determination target discharger D-H, the connection state specification circuit 11 sets the connection state specification signal SLa[m] to a high level in the control periods TSS1 and TSS3, and to a low level in the control period TSS2, respectively, sets the connection state specification signal SLb[m] to a low level in the control periods TSS1, TSS2, and TSS3, and sets the connection state specification signal SLs[m] to a low level in the control periods TSS1 and TSS3, and a high level in the control period TSS2, respectively.

In this case, the discharger D[m] which is specified as the determination target discharger D-H is driven by the drive signal Com-A in the control period TSS1. As a result, in the discharger D[m] which is specified as the determination target discharger D-H, a vibration is generated in the control period TSS1 and the vibration does not calm and remains in the control period TSS2. In the control period TSS2, an electrical signal corresponding to the residual vibration is generated in the determination target discharger D-H is exhibited in the top portion electrode Zu of the piezoelectric element PZ which is included in the determination target discharger D-H. The electrical signal is supplied to the detection circuit 20 via the internal wiring LHs due to the switch SWs[m] being on. In the control period TSS2, the detection circuit 20 detects the potential of the top portion electrode Zu which includes the discharger D[m] which is specified as the determination target discharger D-H as the detection signal Vout[m].

In the control period TSS3, the discharger D[m] which is specified as the determination target discharger D-H is driven such that a micro-vibration is generated by the drive signal Com-A.

In a case in which the individual specification signal Sd[m] specifies the driving for the non-target discharger D-R, the connection state specification circuit 11 sets the connection state specification signal SLa[m] to a low level in the control periods TSS1, TSS2, and TSS3, sets the connection state specification signal SLb[m] to a high level in the control periods TSS1, TSS2, and TSS3, and sets the connection state specification signal SLs[m] to a low level in the control periods TSS1, TSS2, and TSS3, respectively.

In this case, the discharger D[m] which is specified by the non-target discharger D-R is driven by the drive signal Com-B in the discharging state determination process. As a result, the discharger DM which is specified as the non-target discharger D-R is maintained at the second potential in the control periods TSS1 and TSS2 and the discharger D[m] is driven such that the micro-vibration is generated in the control period TSS3.

Figure 11:
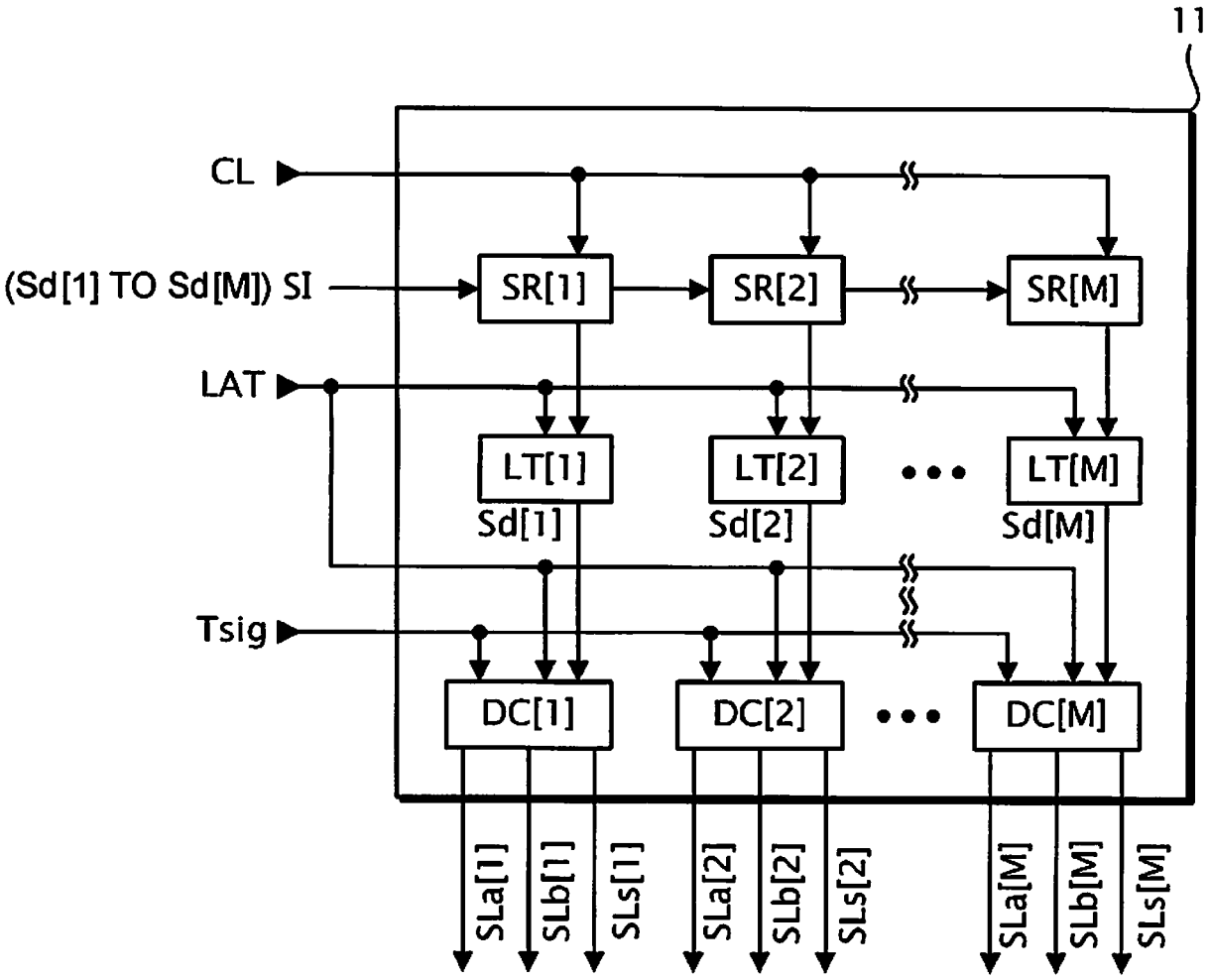
FIG. 11 is a block diagram illustrating an example of the configuration of a connection state specification circuit.

FIG. 11 is a block diagram illustrating an example of the configuration of the connection state specification circuit 11. As illustrated in FIG. 11, the connection state specification circuit 11 generates the connection state specification signals SLa[1] to SLa[M], SLb[1] to SLb[M], and SLs[1] to SLs [M].

Specifically, the connection state specification circuit 11 includes transfer circuits SR[1] to SR[M], latch circuits LT[1] to LT[M], and decoders DC[1] to DC[M] to correspond to the dischargers D[1] to D[M] on a one-to-one basis. Of these, the individual specification signal Sd[m] is supplied to the transfer circuit SR[m]. In FIG. 11, the individual specification signals Sd[1] to Sd[M] are supplied serially, for example, the individual specification signal Sd[m] corresponding to the level m is transferred from the transfer circuit SR[1] to the transfer circuit SR[m] in order in synchronization with the clock signal CL. The latch signal LT[m] latches the individual specification signal Sd[m] which is supplied to the transfer circuit SR[m] at the timing at which the pulse PlsL of the latch signal LAT rises to a high level. As described with reference to FIG. 10 and the like, the decoder DC[m] generates the connection state specification signals SLa[m], SLb[m] and SLs[m] based on the individual specification signal Sd[m], the latch signal LAT, and the period specification signal Tsig.

As described earlier, the detection circuit 20 generates the residual vibration signal RVS based on the detection signal Vout. The residual vibration signal RVS is a signal which shapes the detection signal Vout into a waveform suitable for processing in the discharging state determination circuit 9 by amplifying the amplitude of the detection signal Vout, subtracting a noise component from the detection signal Vout, and the like.

For example, the detection circuit 20 may be configured to include a negative feedback amplifier for amplifying the detection signal Vout, a low-pass filter for attenuating a high-frequency component of the detection signal Vout, and a voltage follower which converts the impedance to output the residual vibration signal RVS of a low impedance.

Discharging State Determination Circuit

Next, a description will be given of the discharging state determination circuit 9.

Generally, the residual vibration which is generated in the discharger D has the following tendencies in cases such as the following. For example, first, the residual vibration which is generated in the discharger D has a natural oscillation frequency which is determined by the shape of the nozzle N, the weight of the ink which fills the cavity 320, the viscosity of the ink which fills the cavity 320, the rigidity of the cavity 320 (particularly, the rigidity of the partitioning walls 340A), and the like. Second, in a case in which a discharging abnormality occurs in the discharger D due to bubbles entering the cavity 320 of the discharger D, the frequency of the residual vibration increases in comparison to a case in which the bubbles do not enter the cavity 320. Third, in a case in which a discharging abnormality occurs in the discharger D due to foreign matter such as paper powder adhering to the vicinity of the nozzle N of the discharger D, the frequency of the residual vibration decreases in comparison to a case in which the foreign matter does not adhere to the vicinity of the nozzle N. Fourth, in a case in which a discharging abnormality occurs in the discharger D due to the thickening of the ink which fills the cavity 320 of the discharger D, the frequency of the residual vibration decreases in comparison to a case in which the ink does not thicken. Fifth, in a case in which the viscosity of the ink which fills the cavity 320 of the discharger D thickens to an extent at which a discharging abnormality occurs in the discharger D, the frequency of the residual vibration decreases in comparison to a case in which foreign matter such as paper powder adheres to the vicinity of the nozzle N of the discharger D. Sixth, in a case in which a discharging abnormality occurs in the discharger D due to the ink not filling the cavity 320 of the discharger D or a case in which a discharging abnormality occurs in the discharger D due to the piezoelectric element PZ being broken and not capable of being displaced, the amplitude of the residual vibration decreases. Seventh, in a case in which the rigidity of the cavity 320 including the partitioning walls 340A is high, the frequency of the residual vibration increases in comparison to a case in which the rigidity is low.

As described above, the residual vibration signal RVS indicates a waveform corresponding to the residual vibration which is generated in the determination target discharger D-H. Specifically, the residual vibration signal RVS indicates a frequency corresponding to the frequency of the residual vibration which is generated in the determination target discharger D-H and indicates an amplitude corresponding to the amplitude of the residual vibration which is generated in the determination target discharger D-H. Therefore, the discharging state determination circuit 9 is capable of determining the discharging state of the ink in the determination target discharger D-H based on the residual vibration signal RVS.

The discharging state determination circuit 9 measures a time length NTc of one period of the residual vibration signal RVS and generates period information Info-T indicating the measurement result when determining the discharging state.

The discharging state determination circuit 9 generates amplitude information Info-S indicating whether or not the residual vibration signal RVS has a predetermined amplitude when determining the discharging state. Specifically, the discharging state determination circuit 9 determines whether or not the potential of the residual vibration signal RVS is greater than or equal to a threshold potential Vth-O having a higher potential than a potential Vth-C having a middle amplitude level of the residual vibration signal RVS in addition to being less than or equal to a threshold potential Vth-U having a lower potential than the potential Vth-C in the period in which the discharging state determination circuit 9 measures the time length NTc of one period of the residual vibration signal RVS. In a case in which the result of the determination is positive, a value, for example, "1" indicating that the residual vibration signal RVS has a predetermined amplitude is set in the amplitude information Info-S, and in a case in which the result of the determination is negative, a value, for example, "0" indicating that the residual vibration signal RVS does not have a predetermined amplitude is set in the amplitude information Info-S.

The discharging state determination circuit 9 generates the determination information Stt indicating the determination result of the discharging state of the ink in the determination target discharger D-H based on the period information Info-T and the amplitude information Info-S.

FIG. 12 is an explanatory diagram for explaining the generation of the determination information Stt in the discharging state determination circuit 9.

As illustrated in FIG. 12, the discharging state determination circuit 9 determines the discharging state in the determination target discharger D-H and generates the determination information Stt indicating the result of the determination by comparing the time length NTc indicated by the period information Info-T to a portion or all of thresholds Tth1, Tth2, and Tth3. Here, in a case in which the cavity 320 of the determination target discharger D-H has a predetermined rigidity, the threshold Tth1 is a value for indicating a boundary between the time length of one period of the residual vibration in a case in which the discharging state of the determination target discharger D-H is normal and the time length of one period of the residual vibration in a case in which bubbles enter the cavity 320 of the determination target discharger D-H. In a case in which the cavity 320 of the determination target discharger D-H has a predetermined rigidity, the threshold Tth2 is a value for indicating a boundary between the time length of one period of the residual vibration in a case in which the discharging state of the determination target discharger D-H is normal and the time length of one period of the residual vibration in a case in which foreign matter adheres to the vicinity of the nozzle N of the determination target discharger D-H. In a case in which the cavity 320 of the determination target discharger D-H has a predetermined rigidity, the threshold Tth3 is a value for indicating a boundary between the time length of one period of the residual vibration in a case in which foreign matter adheres to the vicinity of the nozzle N of the determination target discharger D-H and the time length of one period of the residual vibration in a case in which the ink inside the cavity 320 of the determination target discharger D-H is thickened. The thresholds Tth1 to Tth3 satisfy"Tth1<Tth2<Tth3".

As illustrated in FIG. 12, in the present embodiment, in a case in which the value of the amplitude information Info-S is "1" and the time length NTc indicated by the period information Info-T satisfies "Tth1≤NTc≤Tth2", the discharging state of the ink in the determination target discharger D-H is treated as normal. In this case, the discharging state determination circuit 9 sets the value "1" indicating that the discharging state of the determination target discharger D-H is normal in the determination information Stt.

In a case in which the value of the amplitude information Info-S is "1" and the time length NTc indicated by the period information Info-T satisfies "NTc<Tth1", it is assumed that a discharging abnormality caused by bubbles occurs in the determination target discharger D-H. In this case, the discharging state determination circuit 9 sets the value "2" indicating that a discharging abnormality caused by bubbles occurs in the determination target discharger D-H in the determination information Stt.

In a case in which the value of the amplitude information Info-S is "1" and the time length NTc indicated by the period information Info-T satisfies "Tth2<NTc≤Tth3", it is assumed that a discharging abnormality caused by adherence of foreign matter occurs in the determination target discharger D-H. In this case, the discharging state determination circuit 9 sets the value "3" indicating that a discharging abnormality caused by foreign matter adherence occurs in the determination target discharger D-H in the determination information Stt.

In a case in which the value of the amplitude information Info-S is "1" and the time length NTc indicated by the period information Info-T satisfies "Tth3<NTc", it is assumed that a discharging abnormality caused by thickening occurs in the determination target discharger D-H. In this case, the discharging state determination circuit 9 sets the value "4" indicating that a discharging abnormality caused by thickening occurs in the determination target discharger D-H in the determination information Stt.

Even in a case in which the value of the amplitude information Info-S is "0", it is assumed that a discharging abnormality occurs in the determination target discharger D-H. In this case, the discharging state determination circuit 9 sets the value "5" indicating that a discharging abnormality occurs in the determination target discharger D-H in the determination information Stt.

The discharging state determination circuit 9 generates the determination information Stt based on the period information Info-T and the amplitude information Info-S. The control unit 6 causes the determination information Stt which is generated by the discharging state determination circuit 9 to be stored in the memory unit 5 in association with a level m of the determination target discharger D-H corresponding to the determination information Stt. Accordingly, the control unit 6 manages the determination information Stt[1] to Stt[M] corresponding to the dischargers D[1] to D[M].

In the present embodiment, a case is exemplified in which the determination information Stt is quinary information from "1" to "5". However, the determination information Stt may be binary information indicating whether or not the time length NTc satisfies "Tth1≤NTc≤Tth2". The determination information Stt may include at least information indicating whether or not the discharging state of the ink in the determination target discharger D-H is normal.

Figure 9:
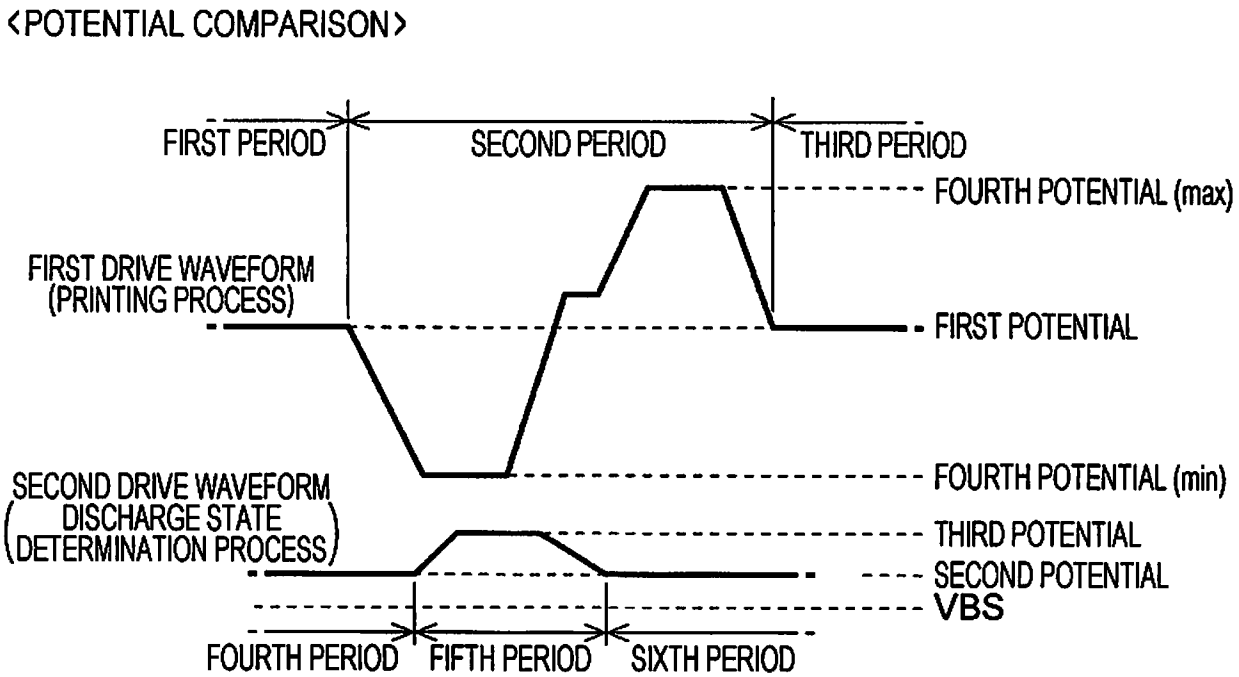
FIG. 9 is a diagram comparing the potentials of a first drive waveform during the printing process and a second drive waveform during the discharging state determination process to each other.

In the present embodiment, FIG. 9 is a diagram for explaining the relationship between the potential in the waveform of the drive signal Com-A during the execution of the printing process and the potential in the waveform of the drive signal Com-B during the execution of the discharging state determination process.

In FIG. 9, the first drive waveform is a waveform for driving the discharger D to cause the ink to be discharged in the drive signal Com-A in the unit printing period Tu-P of the printing process. The second drive waveform is a waveform for driving the discharger D provide the discharger D with a vibration for detecting the residual vibration in the drive signal Com-A in the unit determination period Tu-H of the discharging state determination process.

Since FIG. 9 is merely a diagram for explaining the potential relationship between the first drive waveform and the second drive waveform, the scale of the time axis in the first drive waveform and the scale of the time axis in the second drive waveform do not necessarily match each other.

As illustrated in FIG. 9, the first drive waveform is broadly divided into a first period, a second period, and a third period. Of these, the first period is a period including the starting time of the unit printing period Tu-P and is a period in which the first drive waveform is substantially fixed at the first potential. The third period is a period including the ending time of the unit printing period Tu-P and is a period in which the first drive waveform is substantially fixed at the first potential.

The second period is a period which is positioned between the first period and the third period in the unit printing period Tu-P and is a period for causing the piezoelectric element PZ of the discharger D to be displaced to cause the ink to be discharged.

In the present embodiment, as described above, the potential of the first drive waveform lowers from the first potential to the fourth potential (min) in the second period, briefly maintains the fourth potential (min), subsequently rises to the fourth potential (max) with an intervening fixed potential section midway, and lowers to the first potential after briefly maintaining the fourth potential (max).

The second drive waveform is broadly divided into a fourth period, a fifth period, and a sixth period. Of these, the fourth period is a period including the starting time of the control period TSS1 in the unit determination period Tu-H and is a period in which the second drive waveform is substantially fixed at the second potential. The sixth period is a period including the ending time of the control period TSS1 and is a period in which the second drive waveform is substantially fixed at the second potential.

The fifth period is a period which is positioned between the fourth period and the sixth period in the control period TSS1 and is a period for providing the piezoelectric element PZ with the vibration which serves as a prerequisite when detecting the residual vibration in the control period TSS2.

In the present embodiment, in the fifth period, as described earlier, the potential of the second drive waveform rises from the second potential to the third potential and lowers to the second potential after briefly maintaining the third potential.

In the present embodiment, the first potential, the fourth potential (min), and the fourth potential (max) in the first drive waveform and the second potential and the third potential in the second drive waveform have the following relationship.

second potential<third potential<fourth potential (min)<first potential<fourth potential(max)

In the present embodiment, the first micro-vibration waveform (refer to FIG. 7) in the unit printing period Tu-P protrudes downward, whereas the second micro-vibration waveform (refer to FIG. 8) of the drive signals Com-A and Com-B in the unit determination period Tu-H protrudes upward.

In the present embodiment, a description will be given of the comparative example 1 for explaining the reason that such potentials are set with reference to FIGS. 21 to 23.

Figure 21:
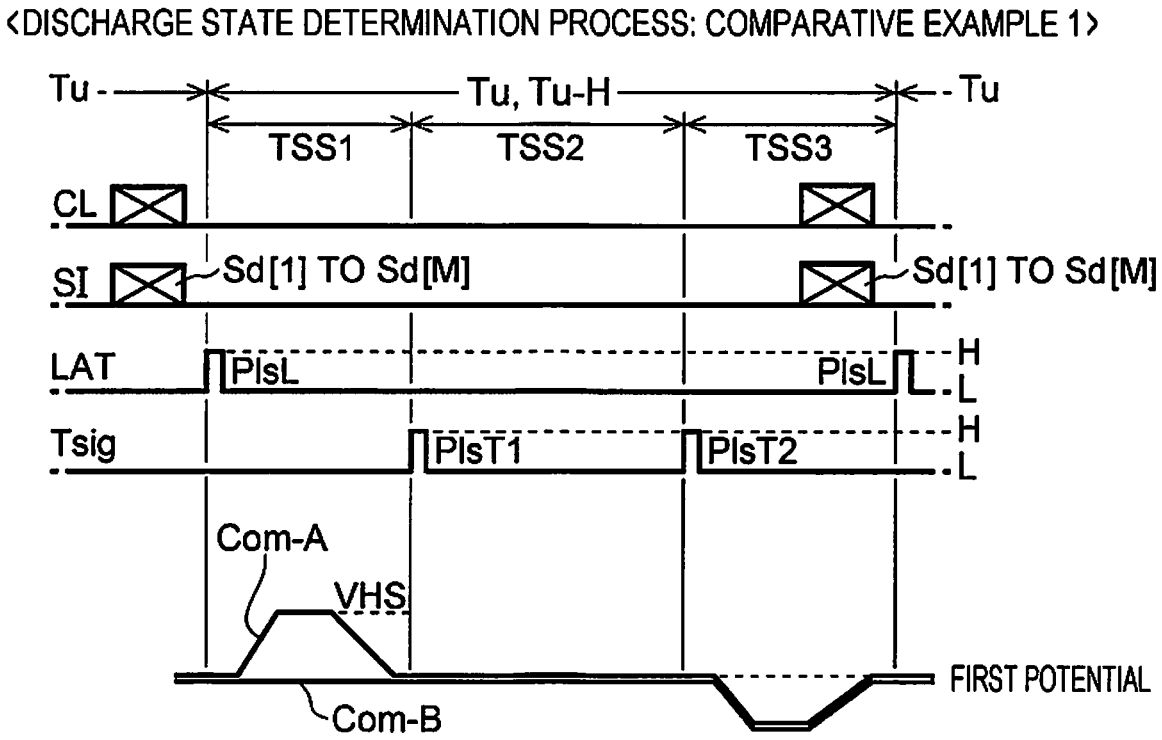
FIG. 21 is a diagram illustrating a waveform during the discharging state determination process among the drive waveforms according to a comparative example 1.

FIG. 21 is a diagram for explaining the waveforms of the drive signals Com-A and Com-B which are used when determining the discharging state in the comparative example 1. The drive signal Com-A according to the comparative example 1 is generally a waveform which shares the first potential during the printing process for the potential during the starting and during the ending in the unit determination period Tu-H.

However, in the drive signal Com-A according to the comparative example 1, in order to align with the time of execution of the printing process and since there is leeway in the lowering direction of the potential, a waveform which protrudes downward is used for the micro-vibration waveform in the control period TSS3.

The drive signal Com-B according to the comparative example 1 is a waveform which shares the first potential during the execution of the printing process for the potential during the starting and during the ending in the unit determination period Tu-H, although, for the same reason as in the drive signal Com-A, a waveform which protrudes downward is used for the micro-vibration waveform in the control period TSS3.

Figure 22:
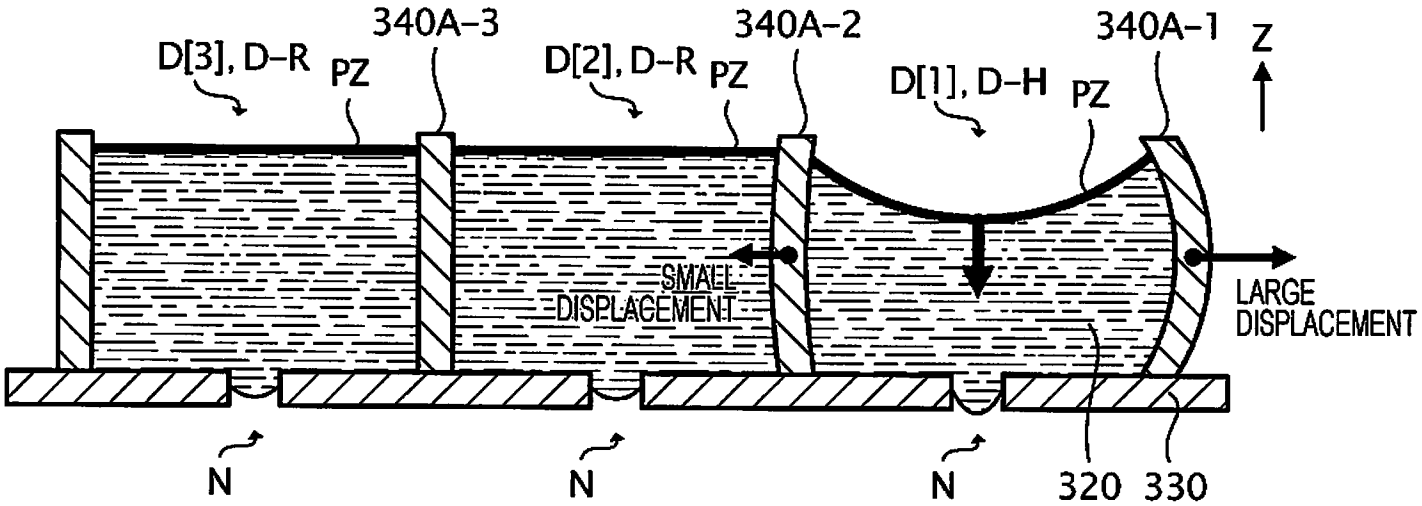
FIG. 22 is an explanatory diagram for explaining the operations of a determination target discharger according to the comparative example 1.
Figure 23:
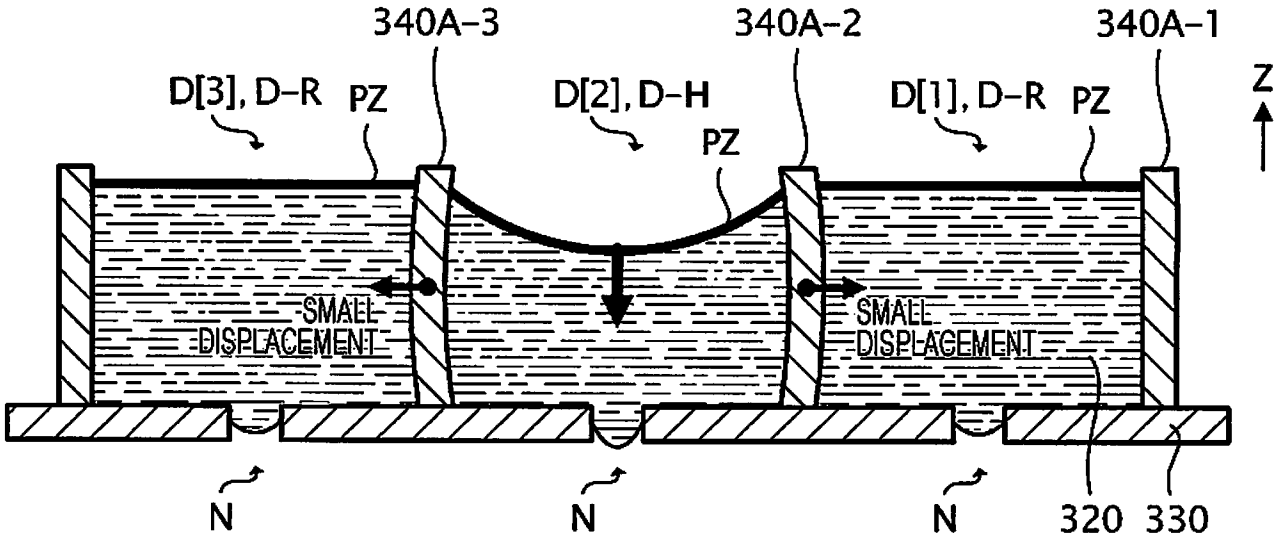
FIG. 23 is an explanatory diagram for explaining the operations of the determination target discharger according to the comparative example 1.

FIGS. 22 and 23 are diagrams for explaining the operations of the dischargers D[1] to D[M] when determining the discharging state using the drive signal Com-A or the drive signal Com-B according to the comparative example 1. Specifically, FIGS. 22 and 23 are diagrams for explaining the operations of the dischargers D[1] to D[M] in the control period TSS2 in a case in which the dischargers D[1] to D[M] are driven as the determination target discharger D-H or the non-target discharger D-R during the execution of the discharging state determination process.

FIGS. 22 and 23 exemplify a case in which M is "3". In FIGS. 22 and 23, each of the nozzles N of the dischargers D[1] and D[3] are the end portion nozzles N-eg which are positioned at the end portions of the nozzle row Ln, and the nozzle N of the discharger D[2] is positioned at the center portion of the nozzle row Ln.

FIG. 22 exemplifies the operations of the dischargers D[1] to D[3] in the control period TSS2 in a case in which the discharger D[1] including the end portion nozzle N-eg is selected as the determination target discharger D-H and the dischargers D[2] and D[3] serve as the non-target dischargers D-R in the unit determination period Tu-H.

As illustrated in FIG. 22, in a case in which the discharger D[1] (an example of a first discharger) including the end portion nozzle N-eg is selected as the determination target discharger D-H and is driven by the drive signal Com-A according to the comparative example 1 in the unit determination period Tu-H, when the top portion electrode Zu of the piezoelectric element PZ[1] which is included in the discharger D[1] changes from the first potential to the potential VHS in the control period TSS1, the piezoelectric element PZ[1] which is included in the discharger D[1] is displaced in the −Z direction. Therefore, in the control period TSS1, since the volume of the cavity 320 of the discharger D[1] decreases and the pressure of the inner portion of the cavity 320 of the discharger D[1] increases, the partitioning walls 340A of the discharger D[1] is displaced to the outside as viewed from the cavity 320. Specifically, of the partitioning walls 340A which are included in the discharger D[1], since there is no pressure from the outside space of the recording head HD on the partitioning wall 340A-1 between the discharger D[1] and the outside space of the recording head HD, the partitioning wall 340A-1 is displaced greatly to the outside (the right side in FIG. 22).

Meanwhile, in a case in which the discharger D[2] (an example of a second discharger) is driven by the drive signal Com-B according to the comparative example 1 as the non-target discharger D-R in the unit determination period Tu-H, the potential of the top portion electrode Zu of the piezoelectric element PZ[2] which is included in the discharger D[2] changes to the first potential in the control period TSS1. Therefore, in the control period TSS1, the displacement of the piezoelectric element PZ[2] which is included in the discharger D[2] is maintained substantially the same as the displacement of the piezoelectric element PZ[2] at the starting time of the unit determination period Tu-H. Accordingly, of the partitioning walls 340A which are included in the discharger D[1], since there is pressure from the cavity 320 of the discharger D[2], the partitioning wall 340A-2 between the discharger D[1] and the discharger D[2] is displaced to the left side by less than the partitioning wall 340A-1.

FIG. 23 exemplifies the operations of the dischargers D[1] to D[3] in the control period TSS1 in a case in which the discharger D[2] not including the end portion nozzle N-eg is selected as the determination target discharger D-H and the dischargers D[1] and D[3] serve as the non-target dischargers D-R in the unit determination period Tu-H.

As illustrated in FIG. 23, in a case in which the discharger D[2] is selected as the determination target discharger D-H and is driven by the drive signal Com-A according to the comparative example 1 in the unit determination period Tu-H, since the piezoelectric element PZ[2] which is included in the discharger D[2] is displaced in the −Z direction and the pressure of the inner portion of the cavity 320 of the discharger D[2] increases in the control period TSS1, the partitioning walls 340A of the discharger D[2] are displaced to the outside as viewed from the cavity 320.

In a case in which the dischargers D[1] and D[3] are driven by the drive signal Com-B according to the comparative example 1 as the non-target dischargers D-R in the unit determination period Tu-H, the potential of the top portion electrodes Zu of the piezoelectric elements PZ which are included in the dischargers D[1] and D[3] changes to the first potential in the control period TSS1. Therefore, in the control period TSS1, the displacement of the piezoelectric elements PZ which are included in the dischargers D[1] and D[3] is maintained substantially the same from the starting time of the unit determination period Tu-H.

Accordingly, of the partitioning walls 340A which are included in the discharger D[2], the partitioning wall 340A-2 between the discharger D[2] and the discharger D[1] is displaced a little to the right side while receiving the pressure from the cavity 320 of the discharger D[1]. Of the partitioning walls 340A which are included in the discharger D[2], the partitioning wall 340A-3 between the discharger D[2] and the discharger D[3] is displaced a little to the left side while receiving the pressure from the cavity 320 of the discharger D[3].

As may be understood from the examples of FIGS. 22 and 23, the partitioning walls 340A of the determination target discharger D-H which is positioned in the vicinity of an end portion of the nozzle row Ln generally have a tendency to be displaced more easily than the partitioning walls 340A of the determination target discharger D-H which is positioned in the vicinity of the center of the nozzle row Ln.

In other words, in a case in which the discharger D which is positioned in the vicinity of an end portion of the nozzle row Ln is the determination target discharger D-H, the rigidity of the partitioning walls 340A in the discharger D has a tendency to be lower than the rigidity of the partitioning walls 340A in the discharger D in a case in which the discharger D which is positioned in the vicinity of the center of the nozzle row Ln is the determination target discharger D-H.

In other words, in the comparative example 1, the rigidity of the cavity 320 which is included in the determination target discharger D-H fluctuates according to the position of the nozzle row Ln in the recording head HD in the control period TSS1. As a result, variation arises in the frequency of the residual vibration which is detected from the determination target discharger D-H according to the position of the nozzle row Ln in the recording head HD.

Specifically, in a case in which the determination target discharger D-H is positioned at the end portion of the nozzle row Ln in the recording head HD, the frequency of the residual vibration which is detected from the determination target discharger D-H has a tendency to be lower than the frequency of the residual vibration which is detected from the determination target discharger D-H in a case in which the determination target discharger D-H is positioned at the center of the recording head HD.

In this manner, in the comparative example 1, since the frequency of the residual vibration which is detected from the determination target discharger D-H easily fluctuates according to the position of the determination target discharger D-H in the recording head HD, in order to perform the discharging state determination precisely, it is necessary to define the thresholds Tth1 to Tth3 which are used in the discharging state determination process individually for each of the dischargers D[m], for example, according to the position of the determination target discharger D-H.

Specifically, in a configuration in which the thresholds Tth1 to Tth3 are individually defined for each of the dischargers D(m) according to the position of the determination target discharger D-H, for example, it is necessary to ascertain which position the determination target discharger D-H is at in the recording head HD and to appropriately read out a set of the thresholds Tth1 to Tth3 corresponding to the position from the memory unit or the like. Therefore, in the comparative example 1, not only is the memory unit or the like necessary, but the work of obtaining, in advance, the set of the thresholds Tth1 to Tth3 according to the position of the determination target discharger D-H is also necessary.

Next, a description of the comparative example 2 in which the tendency for the frequency of the residual vibration which is detected from the determination target discharger D-H to fluctuate easily according to the position of the determination target discharger D-H in the residual vibration HD is reduced to perform the discharging state determination precisely.

Figure 24:
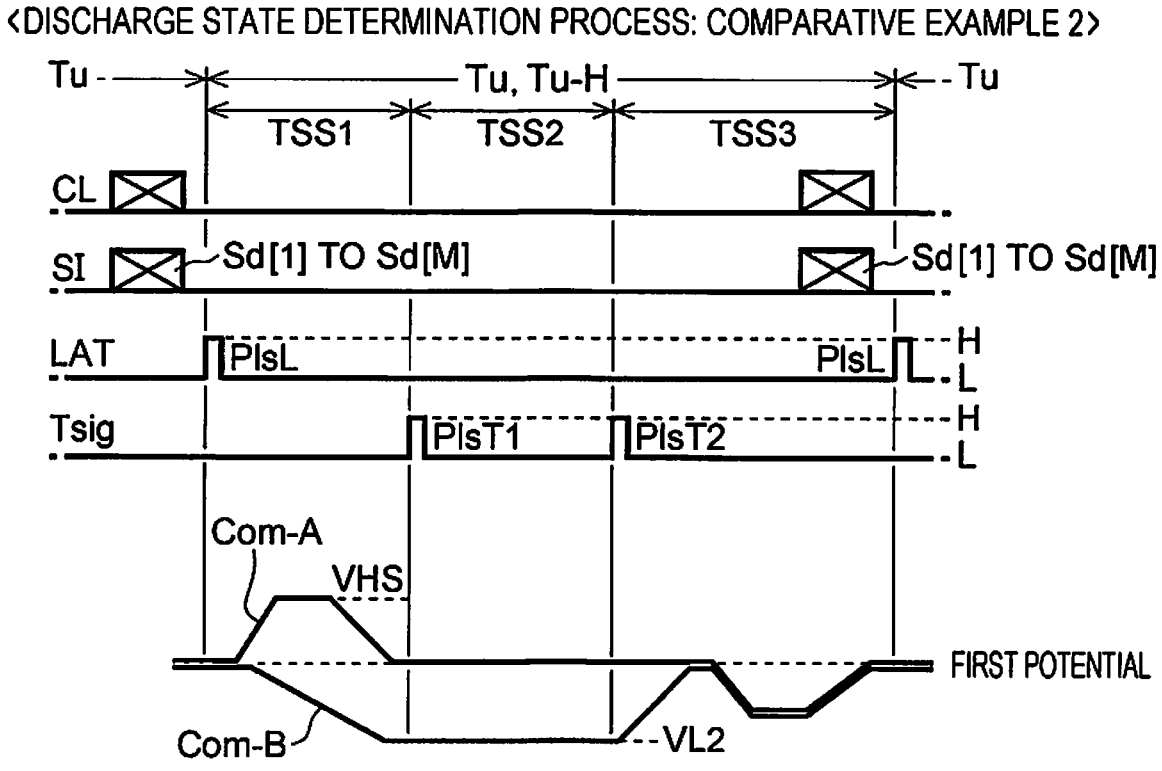
FIG. 24 is a diagram illustrating a waveform during the discharging state determination process among the drive waveforms according to a comparative example 2.

FIG. 24 is a diagram for explaining the waveforms of the drive signals Com-A and Com-B which are used when determining the discharging state in the comparative example 2.

The waveform of the drive signal Com-A according to the comparative example 2 is similar to the waveform of the drive signal Com-A according to the comparative example 1.

The waveform of the drive signal Com-B according to the comparative example 2 is different from in the drive signal Com-B according to the comparative example 1 in the following manner. Specifically, the drive signal Com-B in the comparative example 2 lowers from the first potential to a potential VL2 midway into the control period TSS1, the potential VL2 is maintained in the control period TSS2, rises from midway into the control period TSS3 to the first potential, and subsequently forms the micro-vibration waveform.

When the non-target discharger D-R is driven by the drive signal Com-B according to the comparative example 2 during the execution of the discharging state determination process, the volume of the cavity 320 in the non-target discharger D-R becomes greater than the volume of the cavity 320 at the starting time of the unit determination period Tu-H.

In a case in which the non-target discharger D-R is driven by the drive signal Com-B according to the comparative example 2, the potential VL2 is defined such that the vibration which is generated by the non-target discharger D-R is sufficiently small so as to not be propagated as noise to the determination target discharger D-H.

Next, a description will be given of the effects of the comparative example 2 with reference to FIGS. 25 and 26.

Figure 25:
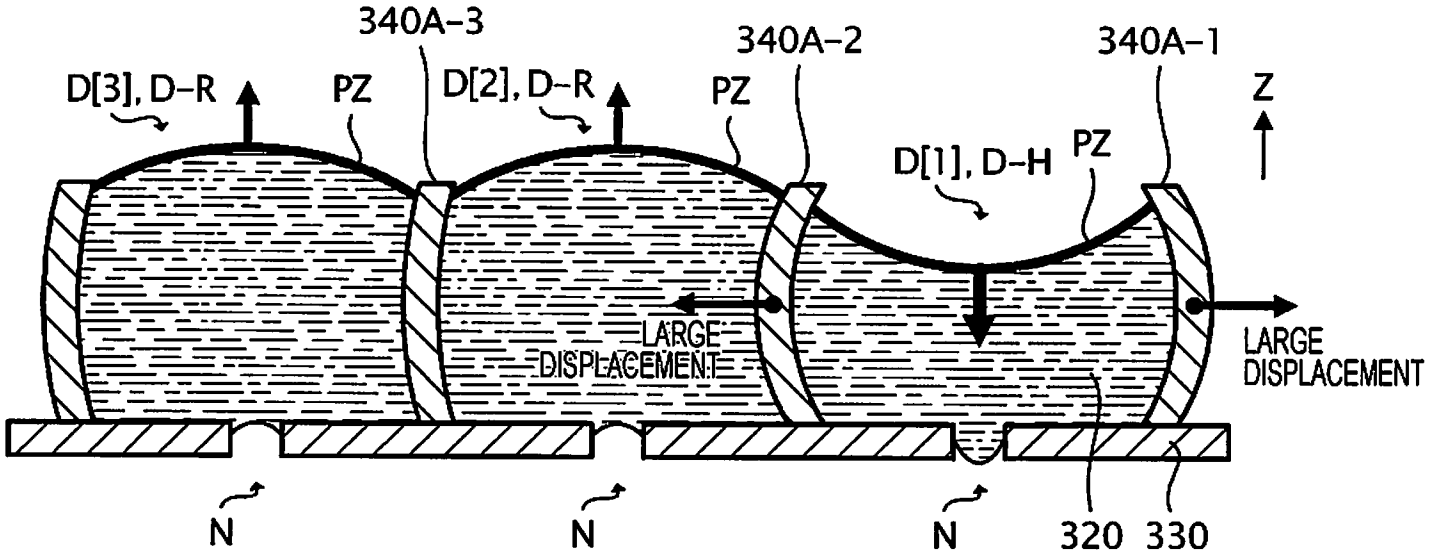
FIG. 25 is an explanatory diagram for explaining the operations of the determination target discharger according to the comparative example 2.
Figure 26:
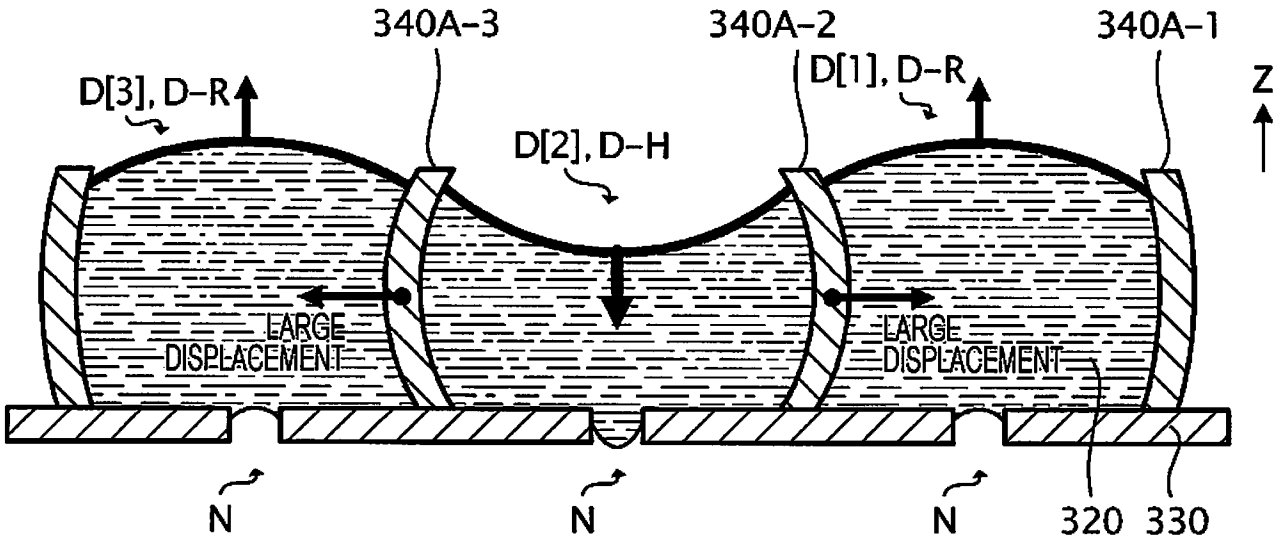
FIG. 26 is an explanatory diagram for explaining the operations of the determination target discharger according to the comparative example 2.

FIGS. 25 and 26 are diagrams for explaining the operations of the dischargers D[1] to D[3] when determining the discharging state using the drive signal Com-A or the drive signal Com-B according to the comparative example 2.

Of FIGS. 25 and 26, FIG. 25 exemplifies the operations of the dischargers D[1] to D[3] in the control period TSS2 in a case in which the discharger D[1] including the end portion nozzle N-eg is selected as the determination target discharger D-H and the dischargers D[2] and D[3] serve as the non-target dischargers D-R in the unit determination period Tu-H. FIG. 26 exemplifies the operations of the dischargers D[1] to D[3] in the control period TSS1 in a case in which the discharger D[2] not including the end portion nozzle N-eg is selected as the determination target discharger D-H and the dischargers D[1] and D[3] serve as the non-target dischargers D-R in the unit determination period Tu-H.

As illustrated in FIG. 25, in a case in which the dischargers D[2] and D[3] are driven by the drive signal Com-B according to the comparative example 2 as the non-target dischargers D-R in the unit determination period Tu-H, when the top portion electrode Zu of the piezoelectric element PZ[2] which is included in the discharger D[2] changes to the potential VL2 in the control period TSS2, the piezoelectric element PZ[2] which is included in the discharger D[2] is displaced in the +Z direction. Therefore, the volume of the inner portion of the cavity 320 of the discharger D[2] increases and the pressure of the inner portion of the cavity 320 of the discharger D[2] decreases.

Therefore, as illustrated in FIG. 25, in the comparative example 2, the difference between the pressure on the partitioning wall 340A-1 from the discharger D[2] and the pressure on the partitioning wall 340A-1 from the outside space of the recording head HD is smaller than the difference between the pressure on the partitioning wall 340A-2 from the discharger D[2] in the comparative example 1 and the pressure on the partitioning wall 340A-1 from the outside space of the recording head HD (refer to FIG. 22).

Therefore, of the partitioning walls 340A of the discharger D[1] it is possible to render the magnitude of the displacement of the partitioning wall 340A-2 between the discharger D[1] and the discharger D[2] and the magnitude of the displacement of the partitioning wall 340A-1 between the discharger D[1] and the outside space of the recording head HD approximately the same, for example.

In other words, in the control period TSS2 of the unit determination period Tu-H in which the discharger D[1] is selected as the determination target discharger D-H, of the partitioning walls 340A which are included in the discharger D[1], the partitioning wall 340A-2 between the discharger D[1] and the discharger D[2] may also be greatly displaced to the left side in FIG. 25 in the same manner as the partitioning wall 340A-1 between the discharger D[1] and the outside space of the recording head HD is greatly displaced to the right side in FIG. 25.

As illustrated in FIG. 26, in a case in which the dischargers D[1] and D[3] are driven by a drive signal Com-BH as the non-target dischargers D-R in the unit determination period Tu-H, the piezoelectric elements PZ which are included in the discharger D[1] and D[3] are displaced in the +Z direction in the control period TSS2. Accordingly, in the control period TSS2 of the unit determination period Tu-H in which the discharger D[2] is selected as the determination target discharger D-H, of the partitioning walls 340A which are included in the discharger D[2], the partitioning wall 340A-2 between the discharger D[2] and the discharger D[1] is greatly displaced to the right side in FIG. 26 and the partitioning wall 340A-3 between the discharger D[2] and the discharger D[3] is greatly displaced to the left side in FIG. 26.

As may be understood from the examples of FIGS. 25 and 26, when the drive signals Com-A and Com-B according to the comparative example 2 are used, in the control period TSS2, it is possible to reduce the difference between the magnitude of the warping in the partitioning walls 340A of the determination target discharger D-H which is positioned in the vicinity of an end portion of the nozzle row Ln and the magnitude of the deformation in the partitioning walls 340A of the determination target discharger D-H which is positioned in the vicinity of the center of the nozzle row Ln as compared to the comparative example 1.

In other words, it is possible to reduce the difference between the rigidity of the partitioning walls 340A in the discharger D in a case in which the discharger D which is positioned in the vicinity of an end portion of the nozzle row Ln is the determination target discharger D-H and the rigidity of the partitioning walls 340A in the discharger D in a case in which the discharger D which is positioned in the vicinity of the center of the nozzle row Ln is the determination target discharger D-H as compared to the comparative example 1.

Therefore, in the comparative example 2, as compared to the comparative example 1, it is possible to suppress the variation in the rigidity of the cavity 320 which is included in the determination target discharger D-H according to the position of the determination target discharger D-H in the recording head HD in the control period TSS2. As a result, in the comparative example 2, it is possible to suppress the fluctuation in the frequency of the residual vibration which is detected from the determination target discharger D-H according to the position of the determination target discharger D-H in the recording head HD. Accordingly, in the comparative example 2, it is possible to perform the discharging state determination precisely without considering the position of the determination target discharger D-H in the recording head HD.

In this manner, in the comparative example 2, since the memory unit or the like becomes unnecessary, the work of obtaining the set of the thresholds Tth1 to Tth3 in advance according to the position of the determination target discharger D-H and the displacement characteristics of the piezoelectric elements PZ in the recording head HD also becomes unnecessary.

However, in the drive signal Com-B according to the comparative example 2, it is necessary to gradually lower from the first potential to the potential VL2 midway into the control period TSS1, maintain the potential VL2 across the control period TSS2 in which the residual vibration is detected, and gradually rise from the potential VL2 to the first potential midway into the control period TSS3. As described above, this is in order to displace the piezoelectric element PZ of the non-target discharger D-R in the +Z direction to lower the pressure of the inner portion of the cavity 320.

In particular, in the drive signal Com-B according to the comparative example 2, it is necessary to expend a comparatively long time on the lowering from the first potential to the potential VL2 in the control period TSS1. This is because, when the potential is caused to change suddenly, there is a possibility that the ink will be erroneously discharged by the vibration accompanying the potential fluctuation and the vibration does not attenuate in the control period TSS2, becomes noise and poorly influences the detection of the residual vibration in the determination target discharger D-H.

Therefore, in the comparative example 2, since in actuality it is necessary to lengthen the time of the control period TSS1, the time is also lengthened for the unit determination period Tu-H which is necessary for determining the discharging state of one discharger D. Therefore, for example, in a case in which the discharging state is continuously determined for all of the M dischargers D while sequentially switching each of the dischargers D to be the determination target discharger D-H, it is pointed out that there is a problem in that the time necessary for the discharging state determination process becomes extremely long from the perspective of the entirety of the recording head HD.

In particular, in recent years there is a strong demand for increased resolution (for example, 300 dpi) of the image which is formed on the recording medium P, the number (M) of the dischargers D is also extremely large at approximately 400 to 600, and the time necessary for the discharging state determination process becomes extremely long. Therefore, from the perspective of the printing apparatus, since the amount of time which does not contribute to the production of the printed matter increases, this leads to a problem in that the printing efficiency decreases.

To counteract this problem, in the present embodiment, at the start and at the end of the unit determination period Tu-H, the potential of the drive signal Com-A and the potential of the drive signal Com-B are both the second potential which is lower the first potential, that is, are both the second potential for expanding the volume of the cavity 320. Therefore, in the drive signal Com-B which is supplied to the non-target discharger D-R, the time for lowering the potential in the control period TSS1 and the time in which the potential is raised in the control period TSS3 are unnecessary.

Therefore, in the present embodiment, there is a merit in that it is possible to achieve a shortening in the time which is necessary for the discharging state determination process as compared to the comparative example 2 while also securing a merit in that it is possible to reduce the tendency, which is present in the comparative example 2, for the frequency of the residual vibration which is detected from the determination target discharger D-H to fluctuate easily according to the position of the determination target discharger D-H, the disposition characteristics of the piezoelectric elements PZ in the recording head HD, and the like to perform the discharging state determination precisely.

Incidentally, in the present embodiment, the second drive waveform (the waveform of the drive signal Com-A in the control period TSS1) for exciting the residual vibration in the determination target discharger D-H in the discharging state determination process and the waveform (the waveforms of the drive signals Com-A and Com-B in the control period TSS3) for causing the discharger D to generate the micro-vibration in the discharging state determination process are both waveforms which protrude upward. In other words, the second potential is set to be lower than the third potential.

Hereinafter, in the present embodiment, a description will be given of the reason that the second potential is set to be lower than the third potential.

It is preferable that the piezoelectric body Zm which is used in the piezoelectric element PZ which is provided in the discharger D be a thin film having a thickness of less than or equal to 5 μm, for example (more specifically, 1.0 μm to 1.5 μm, for example). This is because it is possible to increase the displacement amount of the piezoelectric element PZ with respect to a predetermined applied voltage by reducing the thickness of the piezoelectric body Zm. The piezoelectric element PZ which uses the thin-film piezoelectric body Zm is often manufactured using micro electro mechanical systems (MEMS) technology from the perspective of increasing mass-production capability and reducing the size. It is possible to manufacture the recording head HD which is provided with the multiple (greater than or equal to 600) dischargers D at a high nozzle density (greater than or equal to 300 nozzles per inch) using the MEMS technology, as described earlier.

FIGS. 19A to 19E are partial sectional diagrams of the piezoelectric body Zm, and an explanation of the piezoelectric body Zm will be given hereinafter with reference to the diagrams.

In FIGS. 19A to 19E, a case in which a +W direction and the +Z direction match in a case in which the discharger D including the piezoelectric body Zm is provided in the recording head HD is presumed. In the following explanation, the +W direction and a −W direction which is an opposite direction to the +W direction may be collectively referred to as a W-axis direction.

Figure 19A:
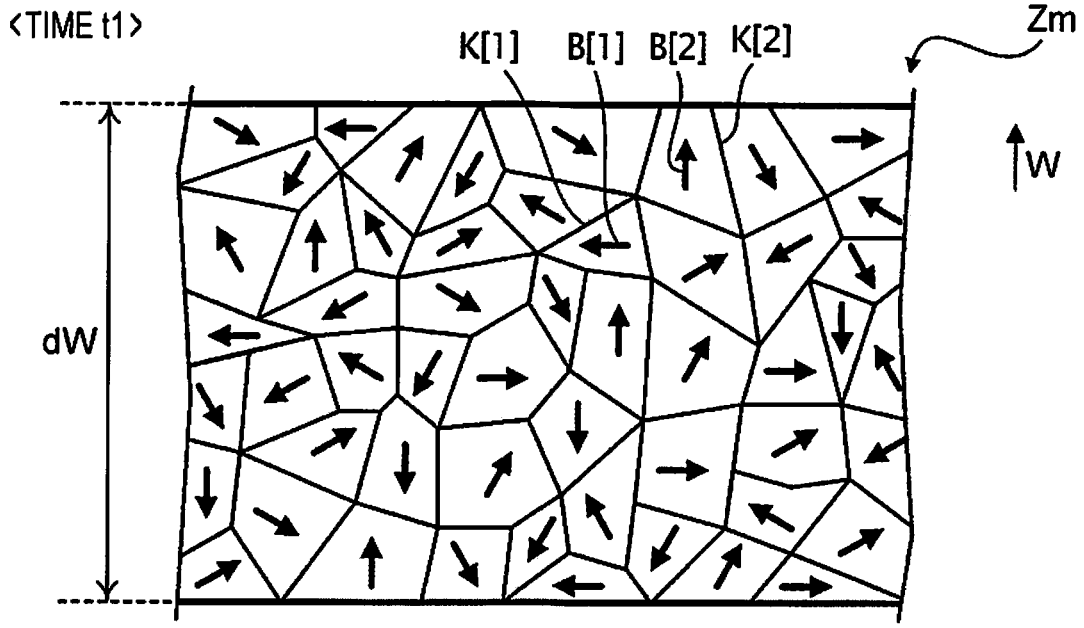
FIG. 19A is a diagram for explaining characteristics of a piezoelectric body.

Since it may be difficult to form the piezoelectric body Zm as a single crystal body, the piezoelectric body Zm is formed as a polycrystalline body which is an aggregate of ferroelectric substance microcrystals. Specifically, as illustrated in FIG. 19A, the piezoelectric body Zm is formed as an aggregate of ferroelectric substance microcrystals K at a time t1 which is the manufacturing time of the piezoelectric body Zm.

At the time of manufacturing, since the directions of the spontaneous polarization of the individual microcrystals face spontaneously inconsistent directions, the piezoelectric properties of the piezoelectric body Zm are not expressed. For example, as illustrated in FIG. 19A, at the time t1, of the plurality of microcrystals K which are included in the piezoelectric body Zm, a polarization direction B[1] of a microcrystal K[1] and a polarization direction B[2] of a microcrystal K[2] are different directions.

Therefore, before the piezoelectric body Zm is installed in the ink jet printer 1, a predetermined direct electric field is applied to the piezoelectric body Zm to perform poling in which the polarization directions are aligned. The piezoelectric properties of the piezoelectric body Zm are expressed due to the poling.

Hereinafter, for the electric field which is applied to the piezoelectric body Zm, an electric field of the same polarity as during the poling will be referred to as a same-polarity electric field and an electric field of an opposite polarity to during the poling will be referred to as an opposite-polarity electric field.

Figure 19B:
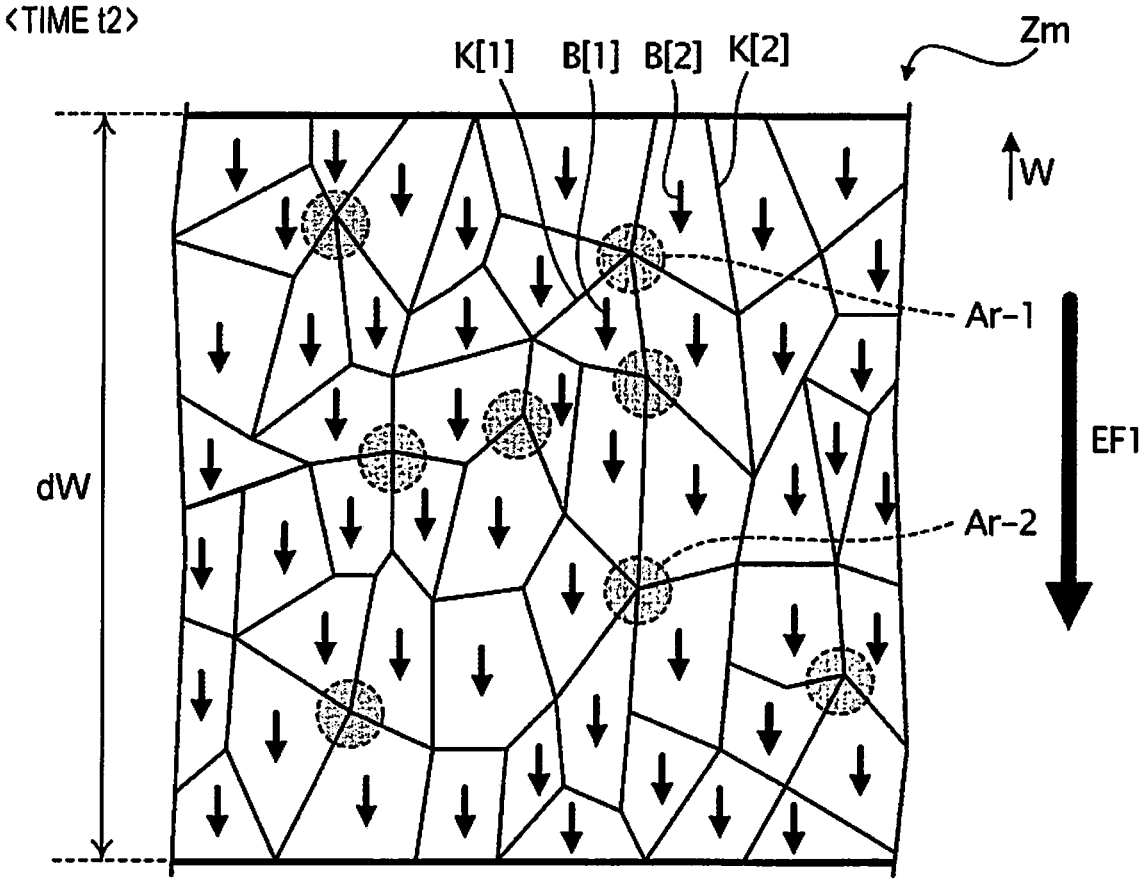
FIG. 19B is a diagram for explaining the characteristics of the piezoelectric body.

For example, as illustrated in FIG. 19B, in a case in which a same-polarity electric field EF1 is applied to the piezoelectric body Zm to perform the poling at a time t2 which is a later time than the time t1 during the manufacturing of the piezoelectric body Zm, the polarization direction B of each of the microcrystals K which are included in the piezoelectric body Zm faces the same direction as the same-polarity electric field EF1, that is, faces the −W direction. Specifically, at the time t2, the polarization direction B[1] of the microcrystal K[1] and the polarization direction B[2] of the microcrystal K[2] are both aligned to the −W direction.

In a case in which the piezoelectric body Zm is subjected to the poling, a thickness dW of the piezoelectric body Zm in the W-axis direction may change. For example, as can be understood when comparing FIG. 19A and FIG. 19B to each other, the thickness dW of the piezoelectric body Zm at the time t2 after subjecting the piezoelectric body Zm to the poling may be thicker than the thickness dW of the piezoelectric body Zm at the time t1 before subjecting the piezoelectric body Zm to the poling. In other words, by being subjected to the poling, the piezoelectric body Zm may be stretched out in the W-axis direction.

Therefore, the stress which is present in the piezoelectric body Zm between the plurality of microcrystals K which are included in the piezoelectric body Zm becomes uneven after the piezoelectric body Zm is subjected to the poling. Accordingly, stress concentration regions Ar at which the stress concentrates are present in the piezoelectric body Zm between the plurality of microcrystals K which are included in the piezoelectric body Zm after the piezoelectric body Zm is subjected to the poling.

When the opposite-polarity electric field is applied to the piezoelectric body Zm during the driving of the piezoelectric element PZ, the polarization directions which are aligned by the poling are disturbed. For example, as illustrated in FIG. 19C, at the time t3 which is a later time than the time t2, when an opposite-polarity electric field EF2 which faces the +W direction is applied to the piezoelectric body Zm, of the plurality of microcrystals K which are included in the piezoelectric body Zm, the polarization directions B of at least a portion of the microcrystals K change to a different direction from the −W direction which is the polarization direction B at the time t1.

Figure 19C:
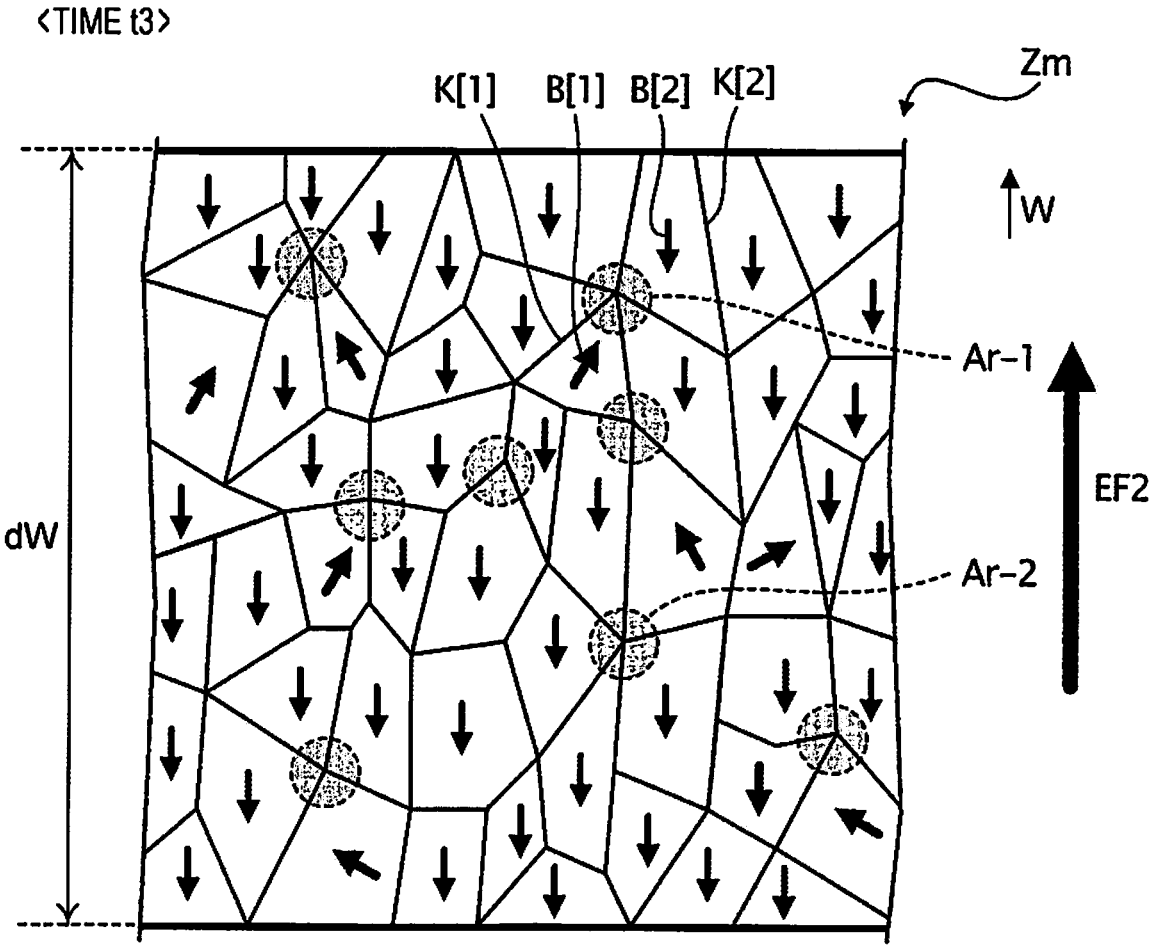
FIG. 19C is a diagram for explaining the characteristics of the piezoelectric body.

In FIG. 19C, a case is exemplified in which the polarization direction B[1] of the microcrystal K[1] changes to a different direction from the −W direction. Even in a case in which the opposite-polarity electric field EF2 is applied to the piezoelectric body Zm, microcrystals K in which the polarization direction B does not change from the −W direction which is the polarization direction B at the time t1 are also present among the plurality of microcrystals K which are included in the piezoelectric body Zm. For example, in FIG. 19C, a case is exemplified in which the polarization direction B[2] of the microcrystal K[2] maintains the same direction as the −W direction. As a result, in the case illustrated in FIGS. 19A to 19E, the polarization direction B[1] of the microcrystal K[1] and the polarization direction B[2] of the microcrystal K[2] face different directions and a disturbance is generated in the polarization direction B. The disturbance in the polarization direction B may increase the degree of the concentration of the stress in the stress concentration regions Ar, for example. Since the disturbance in the polarization direction B lowers the piezoelectric properties, this may cause operational faults in the piezoelectric elements PZ.

Since the piezoelectric body Zm is a polycrystalline body, when partial stress concentration or the like occurs in the inner portion of the piezoelectric body Zm during the manufacturing process or the poling process, latent minute cracks are generated in the inner portion of the piezoelectric body Zm. For example, as illustrated in FIG. 19D, at a time t4 which is a later time than the time t3, minute cracks Cr are generated at the stress concentration regions Ar or the like.

Figure 19D:
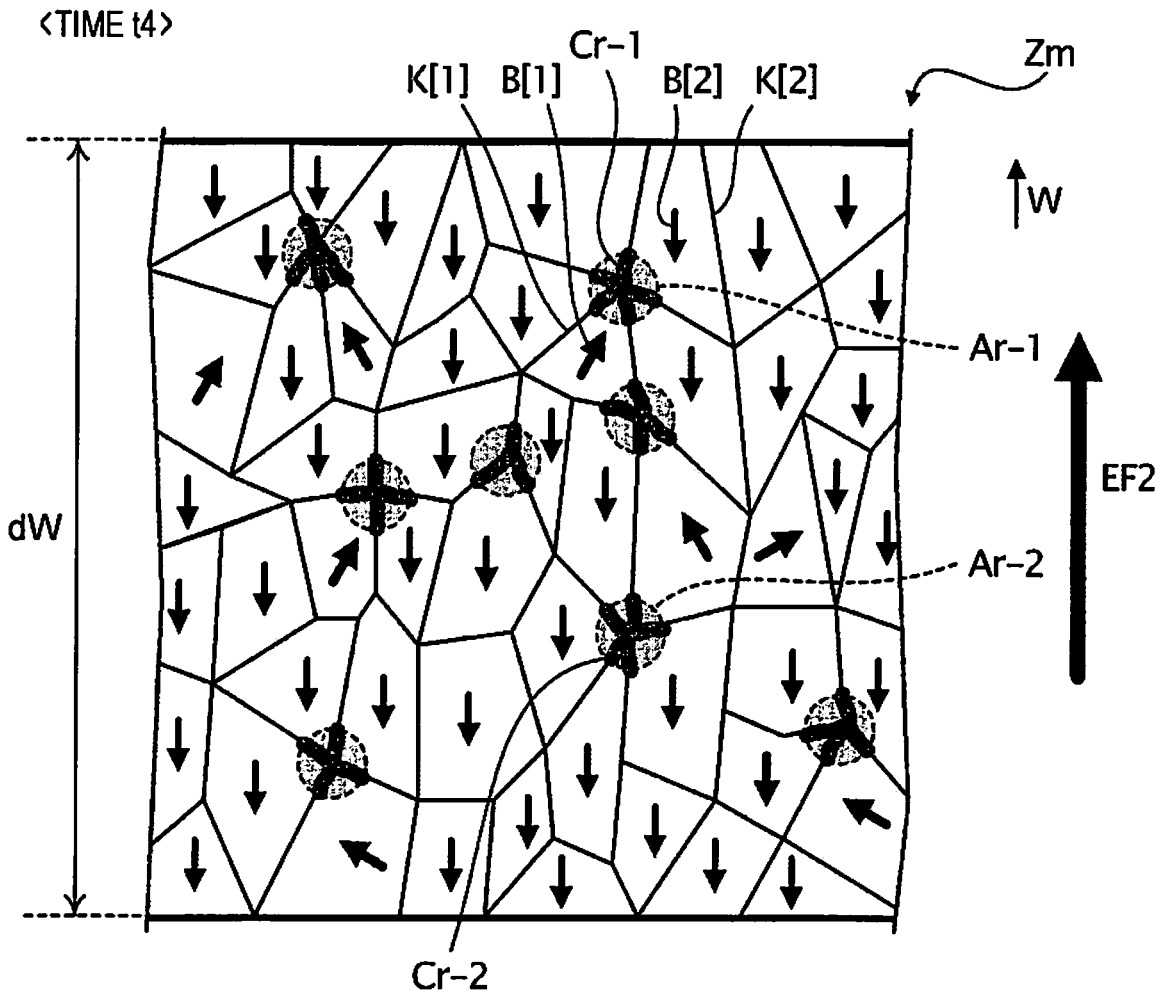
FIG. 19D is a diagram for explaining the characteristics of the piezoelectric body.

FIG. 19D illustrates a case in which a minute crack Cr1 is generated at a stress concentration region Ar1 and a minute crack Cr2 is generated at a stress concentration region Ar2.

Figure 19E:
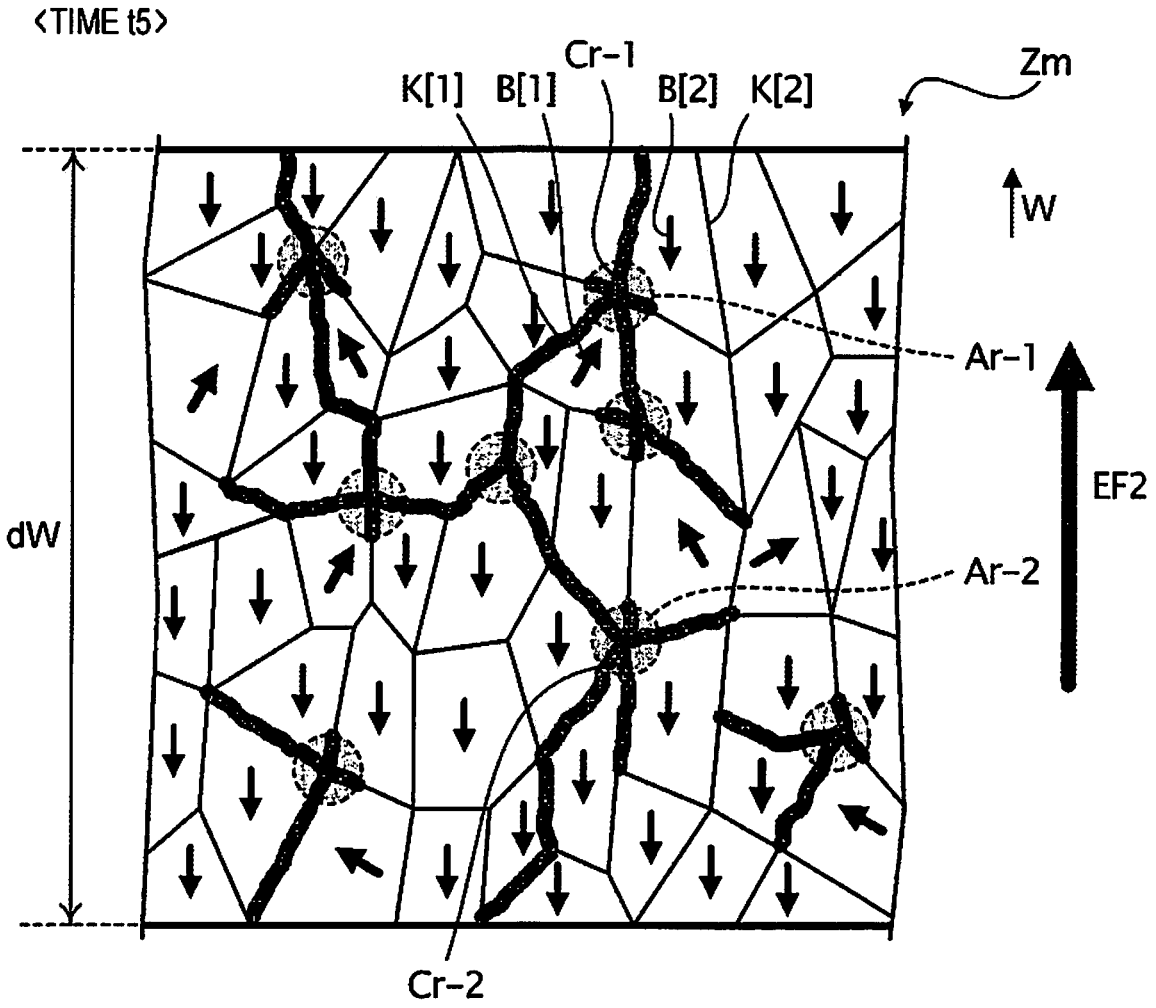
FIG. 19E is a diagram for explaining the characteristics of the piezoelectric body.

The application of the opposite-polarity electric field not only disturbs the polarization direction of the piezoelectric body Zm but may also cause the minute cracks to grow, caused by the manner in which the polarization direction changes being different for each microcrystal. For example, FIG. 19E illustrates a case in which at a time t5 which is a later time than the time t4, the minute crack Cr1 which is generated at the stress concentration region Ar1 and the minute crack Cr2 which is generated at the stress concentration region Ar2 grow, and as a result, the minute crack Cr1 and the minute crack Cr2 bond together.

The minute cracks Cr which are generated in the piezoelectric body Zm may grow, caused by the vibration of the piezoelectric body Zm due to the drive signal Com. The growth of the minute cracks Cr may cause damage to the piezoelectric body Zm. In particular, the cracks which grow easily penetrate the thickness direction in the thin-film piezoelectric body Zm. For example, FIG. 19E illustrates a case in which, at the time t5, the minute cracks Cr which result from the minute cracks Cr1 and Cr2 bonding together and growing penetrate the piezoelectric body Zm in the W-axis direction. When the minute cracks Cr penetrate the piezoelectric body Zm in the thickness direction, electrical shorting occurs between the top portion electrode Zu and the bottom portion electrode Zd and the function of the piezoelectric element PZ is impaired.

In this manner, the application of the opposite-polarity electric field may disturb the polarization directions of the piezoelectric body Zm and reduce the piezoelectric properties, and the piezoelectric body Zm may be destroyed. Accordingly, it is preferable that the application of the opposite-polarity electric field to the piezoelectric element PZ, particularly, application over a long time or application of a high electric field be suppressed.

In the present embodiment, the potential of the bottom portion electrode Zd of the piezoelectric element PZ is the potential VBS as described above. The bottom portion electrode Zd is set to the potential VBS in order to drive the piezoelectric element PZ in an optimal displacement region which is a region in which the electromotive conversion function is close to linear in the electromotive conversion characteristics of the piezoelectric element PZ.

As illustrated in FIG. 9, the reference potential of the first drive waveform is the first potential and the reference potential of the second drive waveform is the second potential which is lower than the first potential. Here, the reference potential of the first drive waveform refers to a potential which is substantially fixed in the period including the starting time and the ending time of the unit printing period Tu-P, and the reference potential of the second drive waveform refers to a potential which is substantially fixed in the period including the starting time and the ending time of the control period TSS1 of the unit determination period Tu-H.

In a case in which the second potential is lower than the first potential, the second potential consequently approaches the potential VBS. In a case in which the waveform which protrudes downward is adopted in order to generate the residual vibration in the control period TSS1 in the state in which the second potential approaches the potential VBS, that is, in a case in which the potential is further lowered from the second potential, there is a possibility that the potential for causing the piezoelectric element PZ to sufficiently vibrate becomes lower than the potential VBS. When the potential which is applied to the top portion electrode Zu of the piezoelectric element PZ becomes lower than the potential VBS, since the electric field which is applied to the piezoelectric element PZ becomes the opposite-polarity electric field, the polarization directions of the piezoelectric body Zm are disturbed, leading to growth of the minute cracks.

Therefore, in the present embodiment, in a case in which the discharging state determination process is executed, the second drive waveform (the waveform of the drive signal Com-A in the control period TSS1) for exciting the residual vibration is set to be a waveform which protrudes upward and the opposite-polarity electric field is not to be applied to the piezoelectric element PZ. In a case in which the discharging state determination process is executed, the second micro-vibration waveform (the waveform of the drive signals Com-A and Com-B in the control period TSS1) which causes the piezoelectric element PZ to generate the micro-vibration for preventing the thickening of the ink is set to be a waveform which protrudes upward for a similar reason.

In this manner, in the present embodiment, since the third potential is set to be higher than the second potential in a case in which the discharging state determination process is executed, as a result of the application of the opposite-polarity electric field to the piezoelectric element PZ being prevented, it is possible to suppress the disturbance of the polarization directions of the piezoelectric body Zm, the growth and promotion of the minute cracks, and so, it is possible to suppress the destruction.

Next, a description will be given of the merits of a case in which the second potential is lower than the first potential from another perspective.

Here, taking the manufacturing process of the recording head HD into consideration, due to variation in the parts, particularly, variation, unevenness, and the like in the film thickness of the piezoelectric body Zm, the electromotive conversion characteristics are often different when a plurality of the recording heads HD is viewed to compare the recording heads HD to each other.

Figure 20:
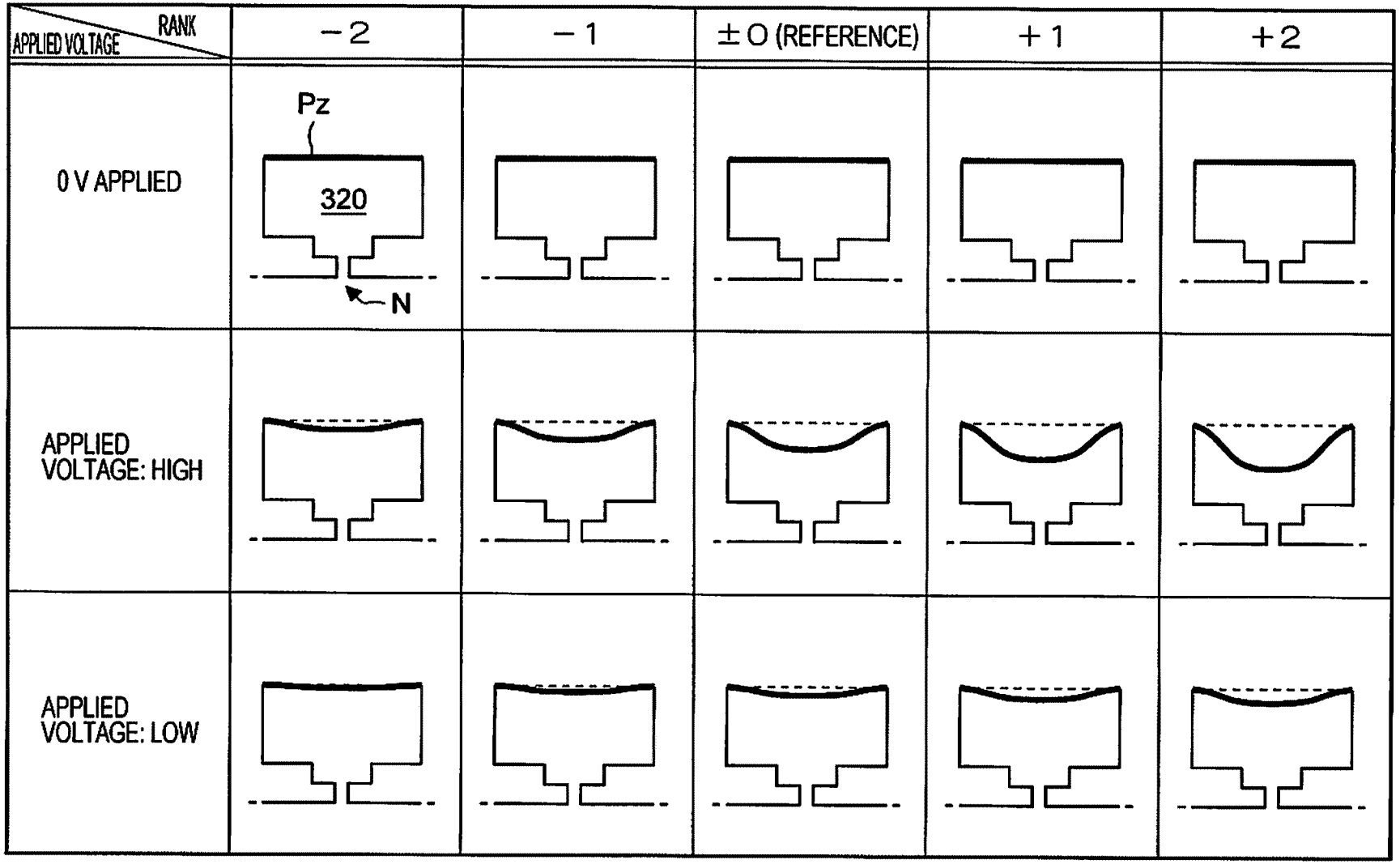
FIG. 20 is a diagram illustrating an example of displacement of piezoelectric elements which are classified by rank.

FIG. 20 is a diagram illustrating an example of the displacement amounts of the piezoelectric elements PZ, which are classified by rank, in the recording head HD.

FIG. 20 illustrates the manner in which the piezoelectric elements PZ are displaced (the degree by which the piezoelectric elements PZ are displaced) in a case in which the ranks of the recording heads HD are classified into five levels of −2, −1, ±0, +1, and +2 and a voltage is applied to the piezoelectric elements PZ of the recording heads HD which are classified into each rank.

Since it may be stated that, in a case in which the same voltage is applied to the piezoelectric element PZ, the smaller the displacement amount of the piezoelectric element PZ, the worse the efficiency of the electromotive conversion, the piezoelectric elements PZ having the smallest displacement amount are classified as −2 which is the lowest rank in the five-level classification. Conversely, since it may be stated that, in a case in which the same voltage is applied to the piezoelectric element PZ, the greater the displacement amount of the piezoelectric element PZ, the better the efficiency of the electromotive conversion, the piezoelectric elements PZ having the greatest displacement amount are classified as +2 which is the highest rank in the five-level classification. The ranking of ±0 is the average (reference).

It is possible to classify the rank by, for example, measuring each of the displacement amounts when a predetermined voltage is applied to a portion of or all of the piezoelectric elements PZ among the M piezoelectric elements PZ in the recording head HD, obtaining the average value of the measurements, and determining which range the average value belongs to among ranges which are determined for each rank.

The voltage which is applied to the piezoelectric element PZ is the difference in potential of the top portion electrode Zu using the potential of the bottom portion electrode Zd as a reference.

As illustrated in FIG. 20, if the voltage which is applied to the piezoelectric element PZ is zero, no substantial variation caused by the rank is seen in the displacement amounts of the piezoelectric elements PZ.

If the voltage which is applied to the piezoelectric element PZ is high, for example +20 V, variation is recognized for each rank in the displacement amounts of the piezoelectric elements PZ and the difference is great.

Meanwhile, if the voltage which is applied to the piezoelectric element PZ is low, for example +5 V, although a little variation is recognized for each rank in the displacement amounts of the piezoelectric elements PZ, the difference is small.

In the present embodiment, during the execution of the printing process, the volume of the cavity 320 is expanded to pull in the ink, and subsequently, the volume of the cavity 320 is contracted to discharge the ink from the nozzle N. Therefore, in the first drive waveform, since the potential is great using a comparatively high first potential as a reference and the piezoelectric element PZ vibrates, that is, since the piezoelectric element PZ is driven at a high voltage, the displacement of the piezoelectric elements PZ becomes more easily varied by the rank.

In order to reduce the influence of the variation, the voltage of the drive signal may be corrected according to the rank.

Meanwhile, during the execution of the discharging state determination process, since the second potential which is close to the potential VBS of the bottom portion electrode Zd is used as a reference, the piezoelectric element PZ is driven at a low voltage. In other words, since the reference potential (the second potential) of the second drive waveform which is used in the discharging state determination process is lower than the reference potential (the first potential) of the first drive waveform which is used in the printing process, the piezoelectric element PZ is driven at a low voltage.

Therefore, in the present embodiment, it is possible to determine the discharging state with high precision without being significantly influenced by the variation by the rank.

OTHER CONFIGURATIONS, MODIFICATION EXAMPLES, AND APPLICATION EXAMPLES

The embodiment may be modified in various ways. Specific modified configurations are exemplified hereinafter. Two or more configurations which are selected in any manner from the following examples may be combined, as appropriate, within a scope that is not mutually contradictory. For elements in the modification examples exemplified hereinafter which have equivalent effects and functions to those of the embodiment, the reference numerals which are referred to in the description given above are reused and the detailed description of each will be omitted, as appropriate.

Other Configuration 1

Figure 13:
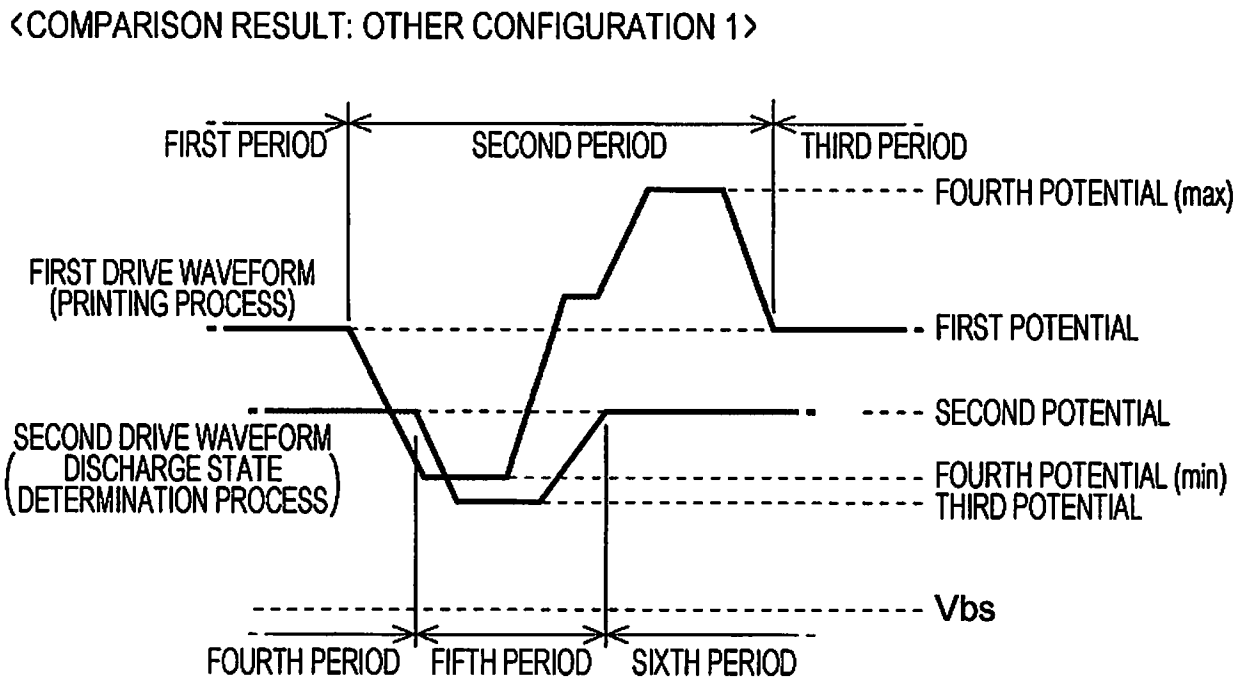
FIG. 13 is a diagram comparing the potentials of the first drive waveform and the second drive waveform according to another configuration 1.

FIG. 13 is a diagram comparing the potentials of the first drive waveform and the second drive waveform according to the other configuration 1.

FIG. 13 differs from the embodiment illustrated in FIG. 9 in that the second drive waveform is a waveform which protrudes downward.

In detail, although the first drive waveform in FIG. 13 is the same as the first drive waveform in FIG. 9, the potential of the second drive waveform in FIG. 13 is substantially fixed at the second potential in the fourth period, lowers to the third potential in the fifth period, rises to the second potential after briefly maintaining the third potential, and is substantially fixed at the second potential in the sixth period.

In the other configuration 1, the first potential, the fourth potential (min), and the fourth potential (max) of the first drive waveform and the second potential and the third potential of the second drive waveform have the following relationship.

third potential<fourth potential(min)<second potential<first potential<fourth potential(max)

It is possible to apply the other configuration 1 as long as there is leeway in the difference from the second potential which is set to be lower than the first potential to the potential VBS. In the other configuration 1, although the difference between the first potential and the second potential is small as compared to the embodiment, this is also a merit of the other configuration 1.

In detail, in a case in which, the process transitions from the printing process to the discharging state determination process as described above, it is necessary to take time to gradually lower the drive signals Com-A and Com-B from the first potential to the second potential. In the other configuration 1, since the difference between the first potential and the second potential is small as compared to the embodiment, it is possible to shorten the time necessary for gradually lowering from the first potential to the second potential.

Similarly, in a case in which the process transitions from the discharging state determination process to the printing process, although it is necessary to take time to gradually raise the drive signals Com-A and Com-B from the second potential to the first potential, it is possible to shorten the time which is necessary for the raising in the other configuration 1.

In the other configuration 1, by setting the second potential in the second drive waveform between the first potential and the third potential in the first drive waveform, it is possible to narrow the range from the minimum value to the maximum value in the first drive waveform and the second drive waveform as compared to the embodiment on top of securing a state in which the second potential is lower than the first potential.

The difference from the second potential to the third potential in the other configuration 1 is greater than the difference from the second potential to the third potential in the embodiment. The reason for this is because, since the second potential in the other configuration 1 is higher than the second potential in the embodiment, a greater potential difference is necessary to obtain the same displacement amount.

Other Configuration 2

Figure 14:
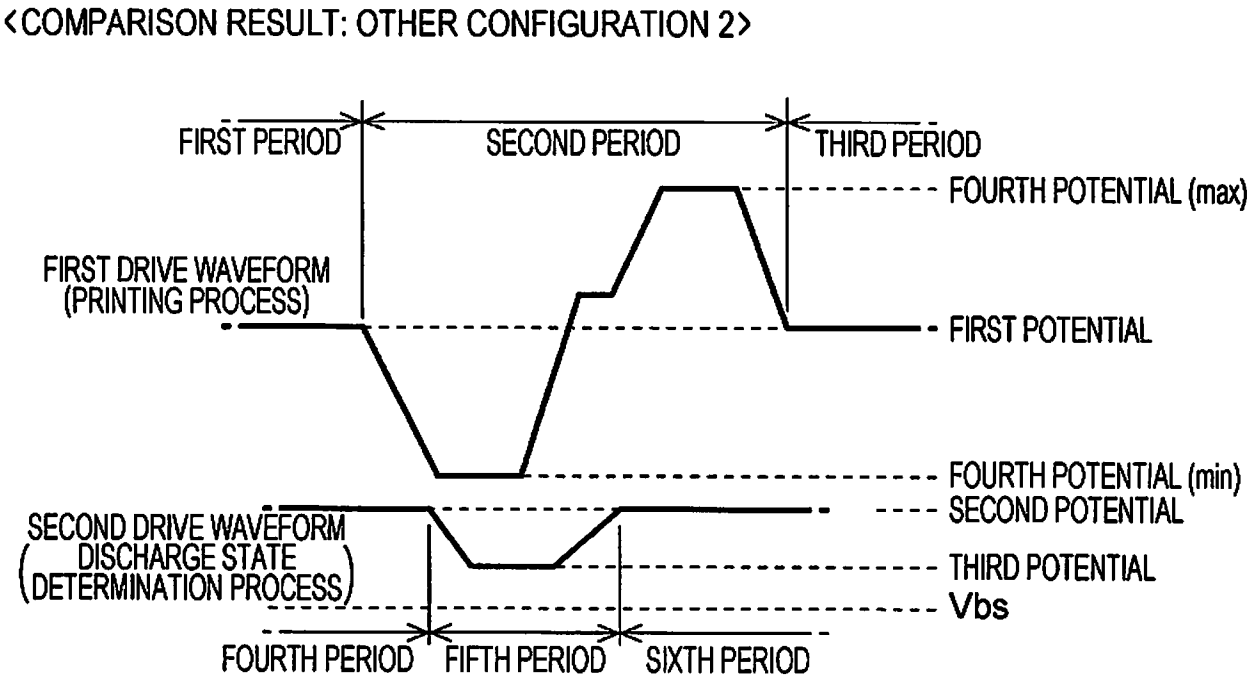
FIG. 14 is a diagram comparing the potentials of the first drive waveform and the second drive waveform according to another configuration 2.

FIG. 14 is a diagram comparing the potentials of the first drive waveform and the second drive waveform according to the other configuration 2.

FIG. 14 differs from the other configuration 1 illustrated in FIG. 13 in that the second potential of the second drive waveform is lower than the third potential of the first drive waveform.

In other words, in the other configuration 2, the first potential, the fourth potential (min), and the fourth potential (max) of the first drive waveform and the second potential and the third potential of the second drive waveform have the following relationship.

third potential<second potential<fourth potential (min)<first potential<fourth potential(max)

It is possible to apply the other configuration 2 as long as there is leeway in the difference from the second potential which is set to be lower than the fourth potential to the potential VBS.

As described above, the lower the voltage which is applied to the piezoelectric element PZ, the smaller the variation in the displacement amounts of the piezoelectric elements PZ for each rank. Therefore, in the other configuration 2, when inspecting the state of the discharger D, it is possible to more accurately provide a displacement to the piezoelectric element PZ for exciting the vibration.

The difference from the second potential to the third potential in the other configuration 2 is smaller than the difference from the second potential to the third potential in the embodiment. The reason for this is because, since the second potential in the other configuration 2 is lower than the second potential in the embodiment, a smaller potential difference is sufficient to obtain the same displacement amount.

With regard to the embodiment, the other configuration 1, and the other configuration 2, the unit printing period Tu-P in the printing process may be divided into two or more periods and different waveforms may be included in the drive signals Com-A and Com-B in each period. For example, a configuration may be adopted in which the unit printing period Tu-P is divided into two, a prior half period and a latter half period, each of the prior half period and the latter half period is disposed in the first drive waveform for the drive signal Com-A, and a waveform for forming a small dot is disposed in the prior half period and the first micro-vibration waveform for preventing the thickening of the ink is disposed in the latter half period for the drive signal Com-B.

In this configuration, it is possible to express four gradations of a large dot, a medium dot, a small dot, and non-recording (no dot is formed) for one dot.

In this configuration, in a case in which, for example, a large dot is formed, the drive signal Com-A may be selected for each of the prior half period and the latter half period of the unit printing period Tu-P. Accordingly, since the ink is discharged a total of two times in the prior half period and the latter half period, a large dot is formed by the combination of the ink which is discharged two times onto the recording medium P, that is, by the combination of a medium dot and a medium dot.

For example, in a case in which a medium dot is formed, the drive signal Com-A is selected in the prior half period of the unit printing period Tu-P and neither the drive signal Com-A or nor the drive signal Com-B may be selected in the latter half period. Accordingly, since the ink is only discharged in the prior half period, the medium dot is formed on the recording medium P by the ink which is discharged.

In a case in which a small dot is formed, the drive signal Com-B is selected in the prior half period of the unit printing period Tu-P and neither the drive signal Com-A or nor the drive signal Com-B may be selected in the latter half period. Accordingly, since the ink is only discharged in the prior half period, the small dot is formed on the recording medium P by the ink which is discharged.

In the case in which non-recording is selected, neither the drive signal Com-A nor the drive signal Com-B is selected in the prior half period of the unit printing period Tu-P and the drive signal Com-B may be selected in the latter half period.

Accordingly, the ink is not discharged in either the prior half period or the latter half period, and the thickening of the ink is prevented by the first micro-vibration waveform in the latter half period.

Greater than or equal to two types of drive signal may be used, and the unit printing period Tu-P in the printing process may be divided into greater than or equal to three parts.

It is possible to apply the configuration to not only multi-com, but also single-com of only one type. Therefore, a description will be given of several examples of single-com hereinafter.

Other Configuration 3

Figure 15:
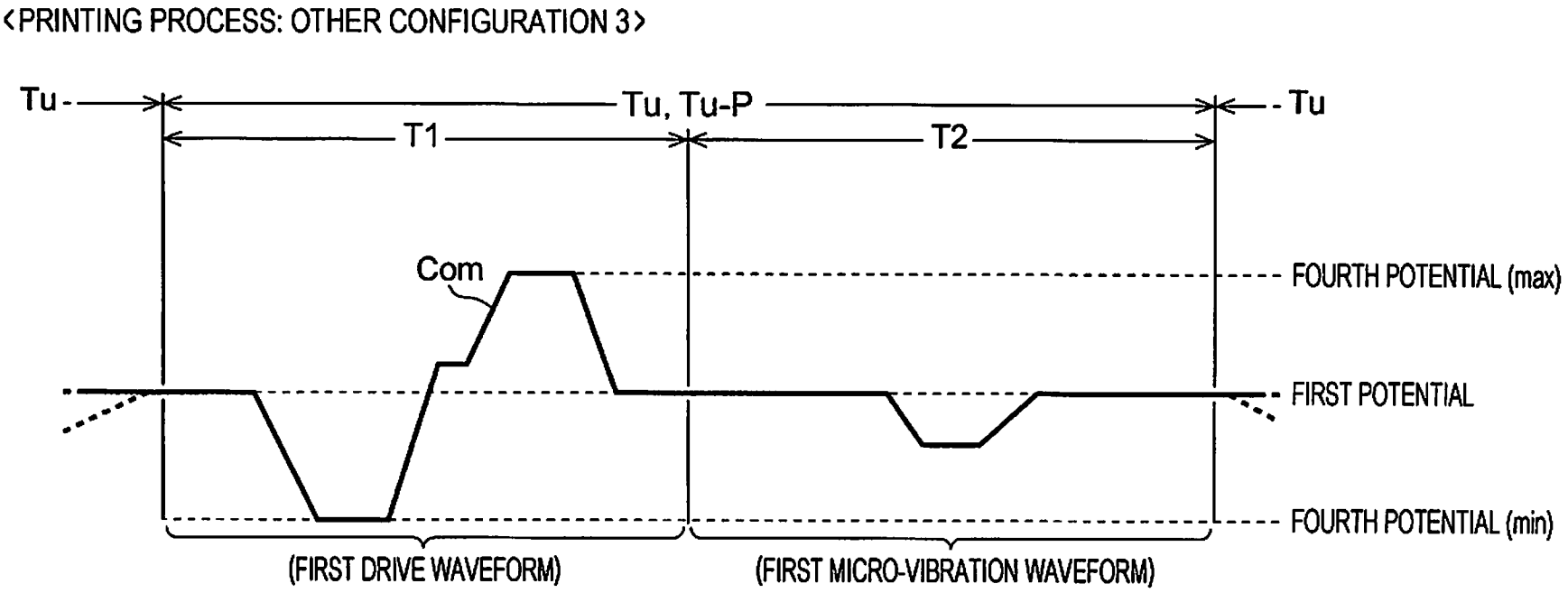
FIG. 15 is a diagram illustrating a waveform during the printing process among the drive waveforms according to another configuration 3.

FIG. 15 is a diagram illustrating a drive waveform which is used in the printing process among the drive waveforms according to the other configuration 3.

As illustrated in FIG. 15, the unit printing period Tu-P is divided into a period T1 and a period T2. The drive signal Com is a first drive waveform which is the same as in the embodiment in the period T1 and a first micro-vibration waveform which is the same as in the embodiment in the period T2.

In a case in which a dot is formed in the drive signal Com according to the other configuration 3, the drive signal Com is selected in the period T1 of the unit printing period Tu-P and the drive signal Com may not be selected in the period T2. Accordingly, the ink is discharged in the period T1 and a dot is formed.

In a case in which a dot is not formed in the drive signal Com according to the other configuration 3, the drive signal Com is not selected in the period T1 of the unit printing period Tu-P and the drive signal Com may be selected in the period T2. Accordingly, the ink is not discharged in the period T1 and the micro-vibration is generated in the period T2 to prevent the thickening of the ink.

Figure 16:
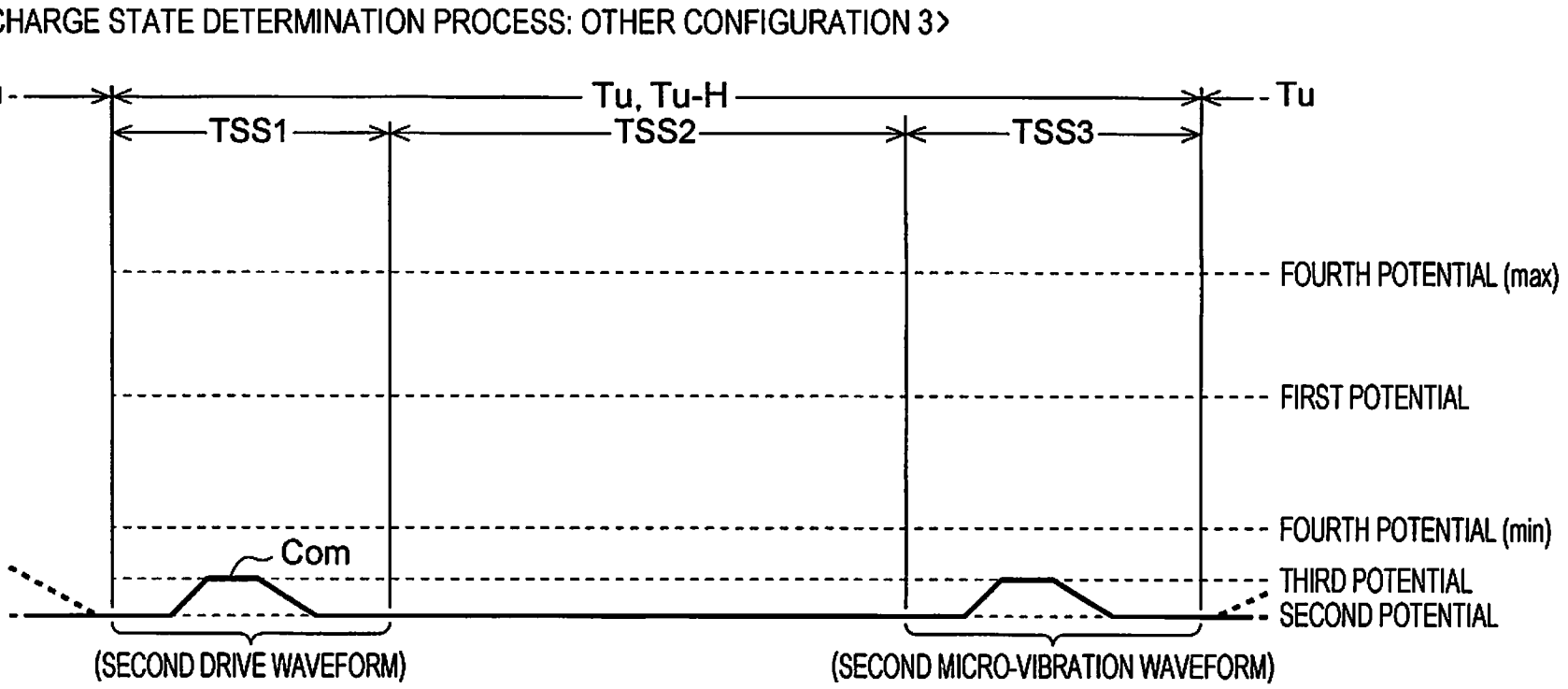
FIG. 16 is a diagram illustrating a waveform during the discharging state determination process among the drive waveforms according to the other configuration 3.

FIG. 16 is a diagram illustrating a drive waveform which is used in the discharging state determination process among the drive waveforms according to the other configuration 3. The drive signal Com which is illustrated in FIG. 16 is the same waveform as the drive signal Com-A (refer to FIG. 8) which is used in the discharging state determination process in the embodiment.

Therefore, in the other configuration 3, the relationship between the potential of the first drive waveform for driving the discharger D to discharge the ink in the drive signal Com in the unit printing period Tu-P of the printing process and the potential of the second drive waveform for driving the discharger D to provide the vibration for detecting the residual vibration in the drive signal com in the unit determination period Tu-H of the discharging state determination process is the same as the relationship in FIG. 9 in the embodiment.

Therefore, it is possible to achieve the same effects as in the embodiment with the other configuration 3.

Other Configuration 4

Figure 17:
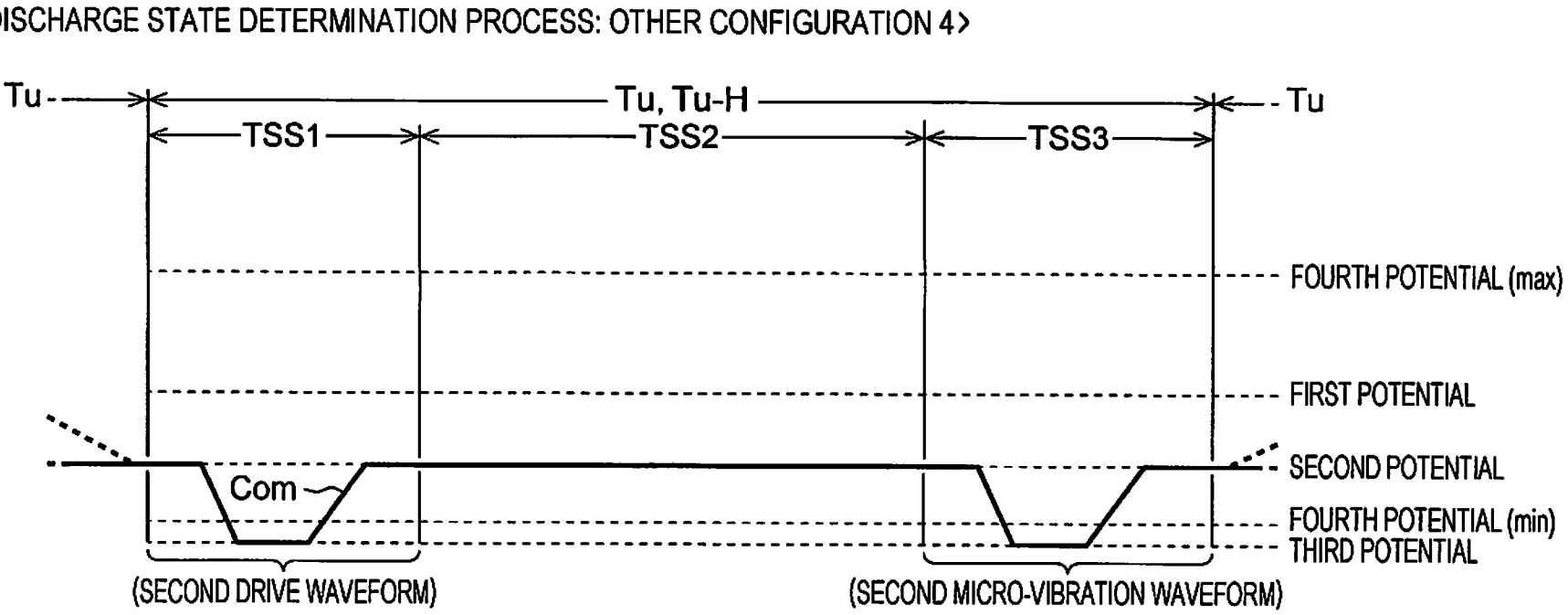
FIG. 17 is a diagram illustrating a waveform during the discharging state determination process among the drive waveforms according to another configuration 4.

FIG. 17 is a diagram illustrating a drive signal which is used in the discharging state determination process among the drive waveforms according to the other configuration 4. The drive signal Com illustrated in FIG. 17 is obtained by disposing the second drive waveform of the other configuration 1 in each of the control periods TSS1 and TSS3.

The same drive signal as in the other configuration 3 (refer to FIG. 15) is used for the drive signal which is used in the printing process in the other configuration 4.

Therefore, in the other configuration 4, the relationship between the potential of the first drive waveform for driving the discharger D to discharge the ink and the potential of the second drive waveform for driving the discharger D to provide the vibration for detecting the residual vibration is the same as the relationship in FIG. 13 in the other configuration 1.

Therefore, it is possible to achieve the same effects as in the other configuration 1 with the other configuration 4.

Other Configuration 5

Figure 18:
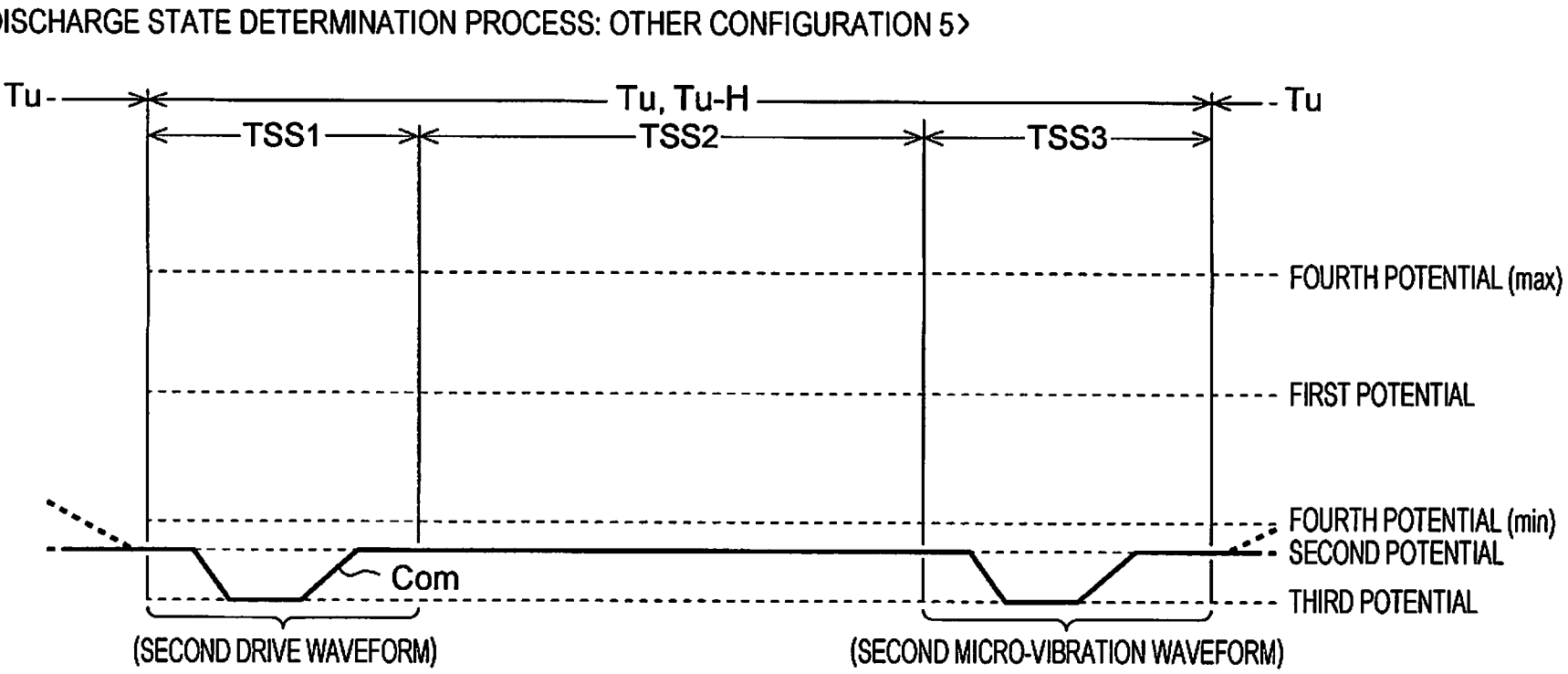
FIG. 18 is a diagram illustrating a waveform during the discharging state determination process among the drive waveforms according to another configuration 5.

FIG. 18 is a diagram illustrating a drive signal which is used in the discharging state determination process among the drive waveforms according to the other configuration 5. The drive signal Com illustrated in FIG. 18 is obtained by disposing the second drive waveform of the other configuration 2 in each of the control periods TSS1 and TSS3.

The same drive signal as in the other configuration 3 (refer to FIG. 15) is used for the drive signal which is used in the printing process in the other configuration 5.

Therefore, in the other configuration 5, the relationship between the potential of the first drive waveform for driving the discharger D to discharge the ink and the potential of the second drive waveform for driving the discharger D to provide the vibration for detecting the residual vibration is the same as the relationship in FIG. 14 in the other configuration 2.

Therefore, it is possible to achieve the same effects as in the other configuration 2 with the other configuration 5.

For the other configurations 3, 4, and 5, the unit printing period Tu-P in the printing process may be divided into three or more periods and waveforms having different amounts of ink to be discharged may be included in each period.

Modification Example 1

In the embodiment and the other configurations 1 to 5 which are described above (hereinafter referred to as "the embodiment and the like"), although the ink jet printer 1 is provided with four head units HU and four ink cartridges 31 which correspond on a one-to-one basis, the configuration is not limited thereto, and the ink jet printer 1 may be provided with one or more head units HU and one or more ink cartridges 31.

In the embodiment and the like which are described above, although the ink jet printer 1 is provided with four discharging state determination circuits 9 corresponding with four head units HU on a one-to-one basis, the configuration is not limited thereto, and the ink jet printer 1 may be provided with one discharging state determination circuit 9 for a plurality of head units HU, and may be provided with a plurality of discharging state determination circuits 9 for one head unit HU.

On the other hand, in the embodiment and the like which are described above, although the control unit 6 selects one discharger D as the determination target discharger D-H from among the M dischargers D which are provided in each head unit HU in each of the unit determination periods Tu-H, the configuration is not limited thereto, and the control unit 6 may select two or more dischargers D as the determination target dischargers D-H from among the M dischargers D which are provided in each of the head units HU in each of the unit determination periods Tu-H.

Modification Example 2

In the embodiment and the like which are described above, although the discharging state determination circuit 9 is provided as a separate circuit from the control unit 6, the invention is not limited to this configuration, and a portion or all of the discharging state determination circuit 9 may be implemented as functional blocks which are realized by the CPU of the control unit 6 or the like operating according to a control program.

Modification Example 3

In the embodiment and the like which are described above, although the ink jet printer 1 which serves as a printing apparatus is exemplified as a serial printer, the configuration is not limited thereto. For example, the ink jet printer 1 may be a so-called line printer in which a plurality of nozzles N is provided to extend more widely than the width of the recording medium P in the head module HM.

What is claimed is:

1. A printing apparatus comprising:

a first discharger which discharges a liquid in accordance with driving of a first piezoelectric element;

a drive signal generating unit which generates a drive signal including a first drive waveform for driving the first discharger and discharging the liquid, during a printing process, a first micro-vibration waveform for driving the first discharger and not discharging the liquid, during the printing process, a second drive waveform for driving the first discharger and inspecting the first discharger, during a discharging state determination process, and a second micro-vibration waveform for driving the first discharger and not discharging the liquid, during the discharging state determination process; and a residual vibration detection unit which detects an electrical signal corresponding to a residual vibration which is generated inside the first discharger in accordance with supplying of the second drive waveform, wherein the first drive waveform becomes a first potential during a first period, becomes a fourth potential during a second period, and becomes the first potential during a third period, wherein the second drive waveform becomes a second potential during a fourth period, becomes a third potential during a fifth period, and becomes the second potential during a sixth period, and wherein the first micro-vibration waveform and the second micro-vibration waveform are different from each other.

2. The printing apparatus according to claim 1, wherein the second potential is lower than the first potential.

3. The printing apparatus according to claim 1, wherein the first micro-vibration waveform includes a waveform which changes from the first potential to a lower potential than the first potential, and wherein the second micro-vibration waveform includes a waveform which changes from the second potential to a higher potential than the second potential.

4. The printing apparatus according to claim 1, wherein the residual vibration detection unit detects an electrical signal corresponding to a residual vibration which is generated by the first discharger in the sixth period.

5. The printing apparatus according to claim 1, further comprising:

a second discharger which discharges a liquid in accordance with driving of a second piezoelectric element, wherein the first discharger is included in a discharger row which is formed of a plurality of dischargers, and wherein the first discharger and the second piezoelectric element are driven under the same driving conditions and are inspected under the same inspection conditions.

6. The printing apparatus according to claim 5, wherein the first discharger is a discharger which is positioned at an end of the discharger row, and wherein the second discharger is a discharger which is not positioned at an end of the discharger row.

7. The printing apparatus according to claim 1, further comprising:

a plurality of the discharger rows, wherein the plurality of discharger rows are driven under the same driving conditions and are inspected under the same inspection conditions.

8. The printing apparatus according to claim 1, wherein an other end of each of the piezoelectric elements is maintained at a predetermined potential.

* * * * *